United States Patent [19]

David

[11] Patent Number: 4,653,274

[45] Date of Patent: Mar. 31, 1987

[54] METHOD OF CONTROLLING A FREE PISTON EXTERNAL COMBUSTION ENGINE

[76] Inventor: Constant V. David, 4952 Field St., San Diego, Calif. 92110

[21] Appl. No.: 789,451

[22] Filed: Oct. 21, 1985

Related U.S. Application Data

[63] Continuation-in-part of Ser. No. 586,812, Mar. 6, 1984, Pat. No. 4,561,252.

[51] Int. Cl.[4] ..... F02B 71/04

[52] U.S. Cl. ..... 60/595; 123/46 A

[58] Field of Search ..... 60/595; 123/46 R, 46 A

[56] References Cited

U.S. PATENT DOCUMENTS

| | | | |
|---|---|---|---|
| 1,620,565 | 3/1927 | McKeown | 123/46 A |
| 1,858,102 | 5/1932 | McKeown | 123/46 A |
| 2,595,396 | 5/1952 | Lee | 60/595 X |
| 2,814,551 | 11/1957 | Broeze et al. | 123/46 A X |
| 2,943,610 | 7/1960 | Foster | 60/595 X |
| 3,365,879 | 1/1968 | Panhard | 60/595 |
| 3,643,638 | 2/1972 | Braun | 60/595 X |
| 4,399,654 | 8/1983 | David | 60/595 |
| 4,541,243 | 9/1985 | Clark | 60/595 |

FOREIGN PATENT DOCUMENTS

| | | | |
|---|---|---|---|
| 208150 | 10/1924 | United Kingdom | 60/595 |

*Primary Examiner*—Michael Koczo

[57] ABSTRACT

A free-piston combustion member comprising air compression and gas expansion chambers is combined with a rotary motor. The rotary motor shaft drives an air compressor, receives power from the gases expanding in an expansion chamber and provides residual torque and power for external use. Two combustion chambers located at each end of the free piston receive compressed air and fuel for combustion outside of the rotary motor assembly. The motion of the free piston between the two combustion chambers is independent of the motor rotary motion. The air admission inside the combustion chambers, the fuel injection and the combustion initiation process are all controlled and timed by the free piston movement back and forth. A heat exchanger is located between the combustion-chamber/free-piston assembly and the rotary motor. It also serves as storage tank for the compressed air before its admission in the combustion chambers in order to smooth out pressure surges in the compressed air entering the combustion chambers. The power output of the rotary motor is determined by the adjustment of the amounts of air and fuel admitted in the combustion chambers. Air and fuel admissions are controlled simultaneously in a programmed manner. The results are a slower, more efficient combustion process and the concomitant possible use of inexpensive fuels, and the emission of a lesser amount of pollutants in the exhaust gas.

8 Claims, 39 Drawing Figures

FIG. 1
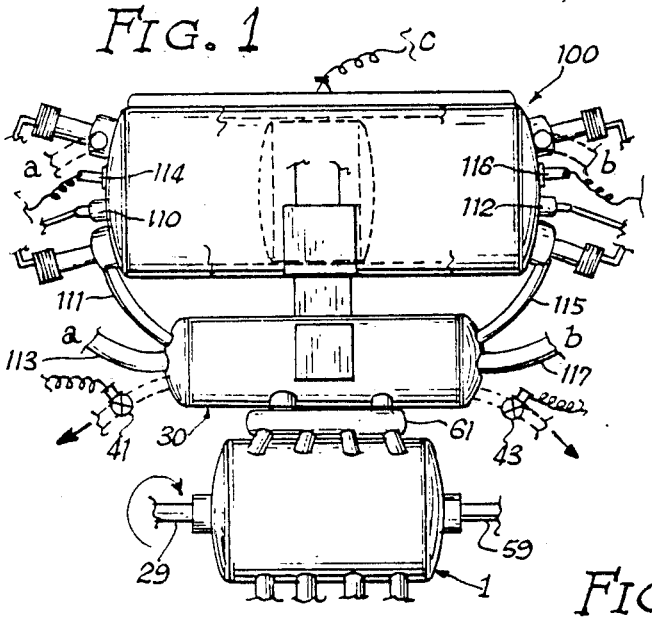
FIG. 2
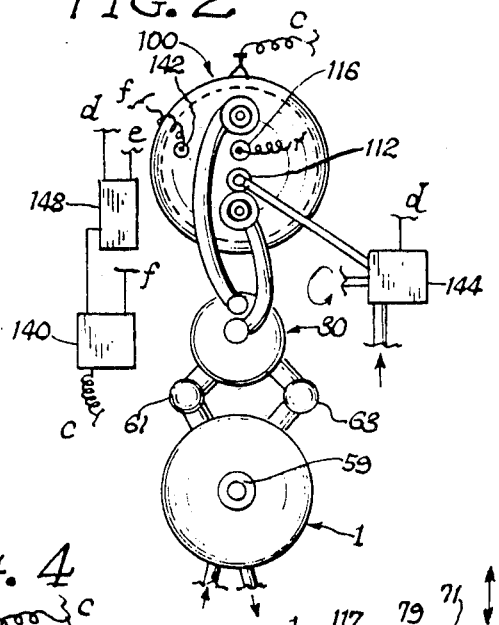
FIG. 4
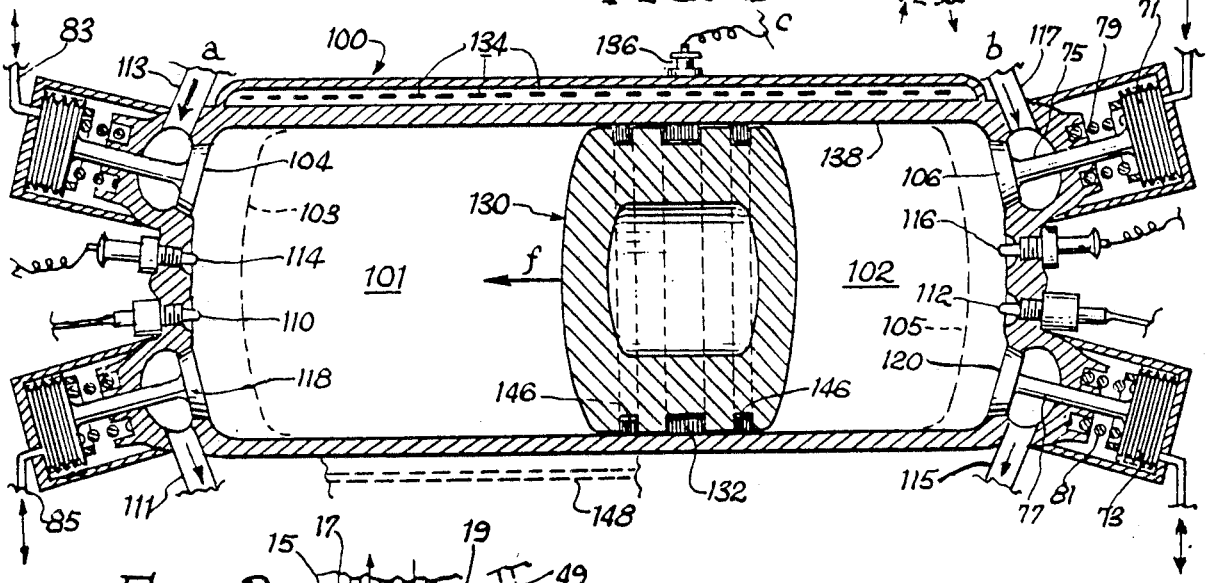
FIG. 3
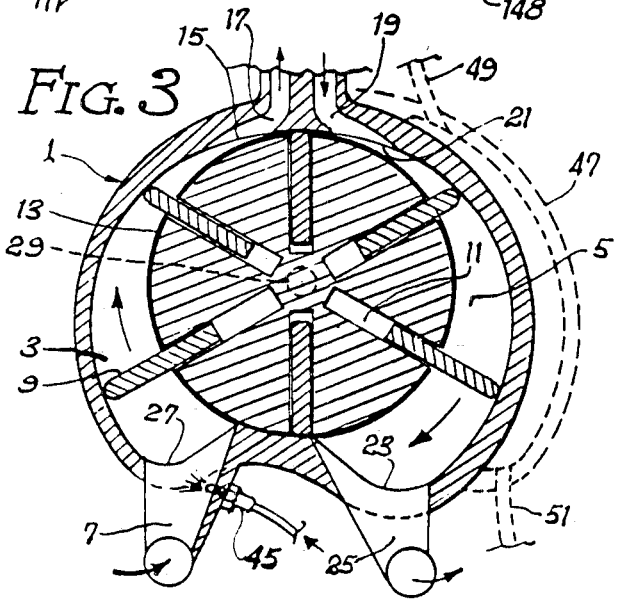
FIG. 5 FIG. 6 FIG. 7
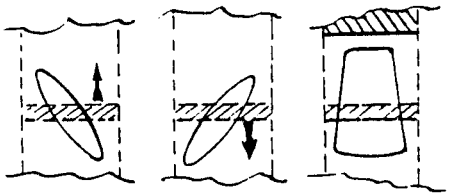
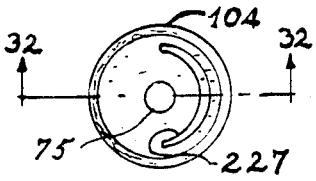
FIG. 33

FIG. 23
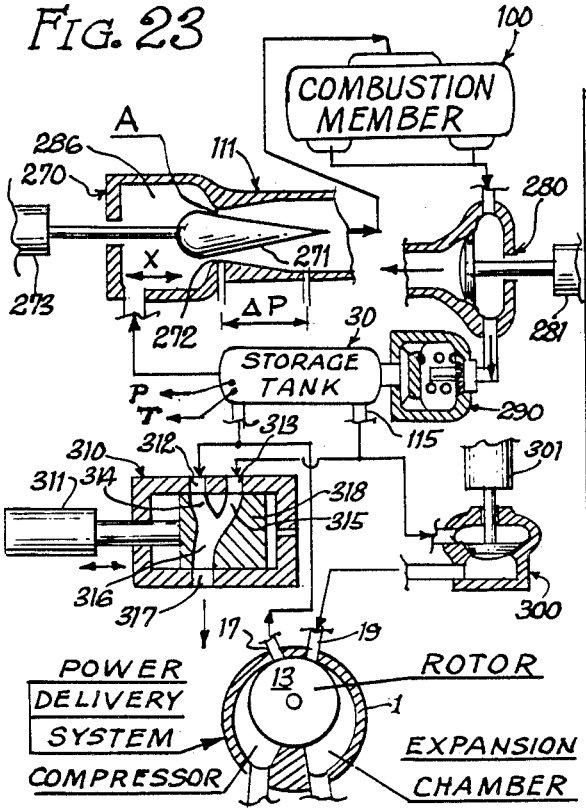
FIG. 29
STOP CYCLE
| STEP | | SEQUENCE | RESULT |
|---|---|---|---|
| Switch | | ON / OFF | STARTS CYCLE |
| C.P.U. | | ON / OFF | ENGINE STOPPED |
| VALVES | INLET/INTAKE | O / C | SEE * BELOW |
| | DUMP | O / C | STORAGE TANK EMPT. |
| | BY-PASS | O / C | *COMBUSTION MEMBER STOPS |
| | Exhaust | O / C | |
| Starter | | ON / OFF | N.A. |
| Brake | | ON / OFF | PISTON STOPS |
| Ignition | | ON / OFF | SEE * ABOVE |
| Fuel Inj. | | ON / OFF | |
FIG. 38
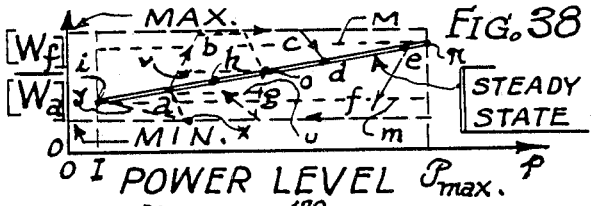
FIG. 30
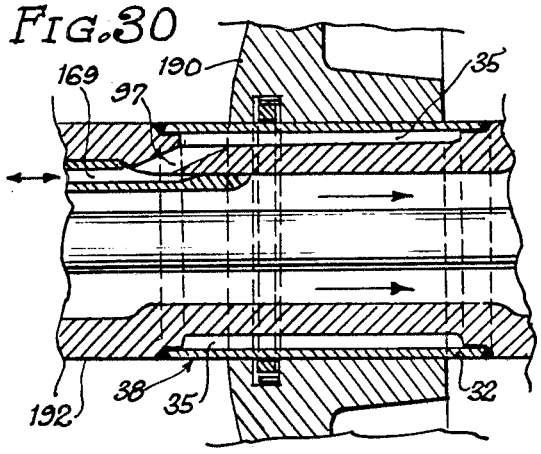
FIG. 31
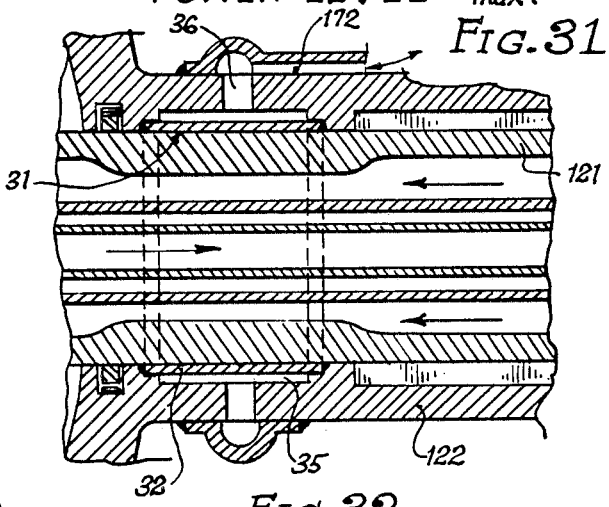
FIG. 12
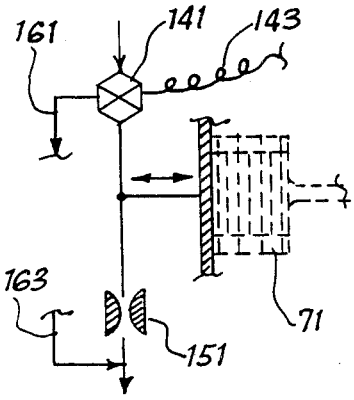
FIG. 13
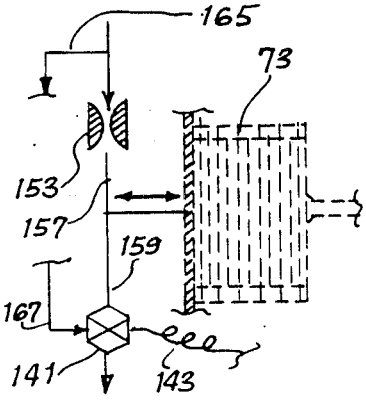
FIG. 32
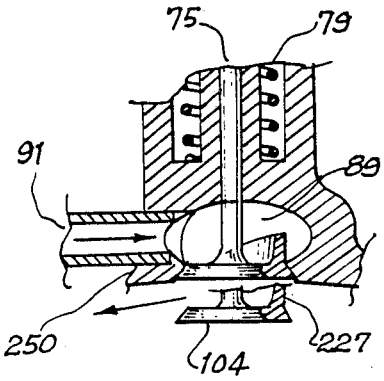

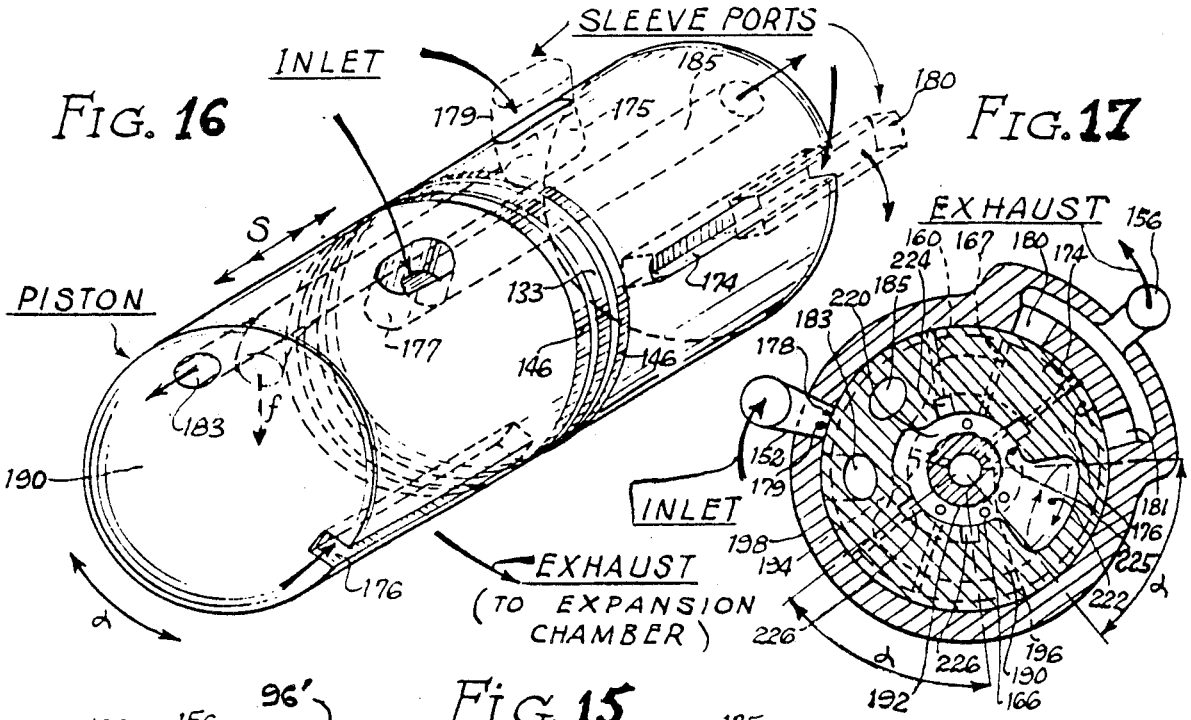
FIG. 16
FIG. 17
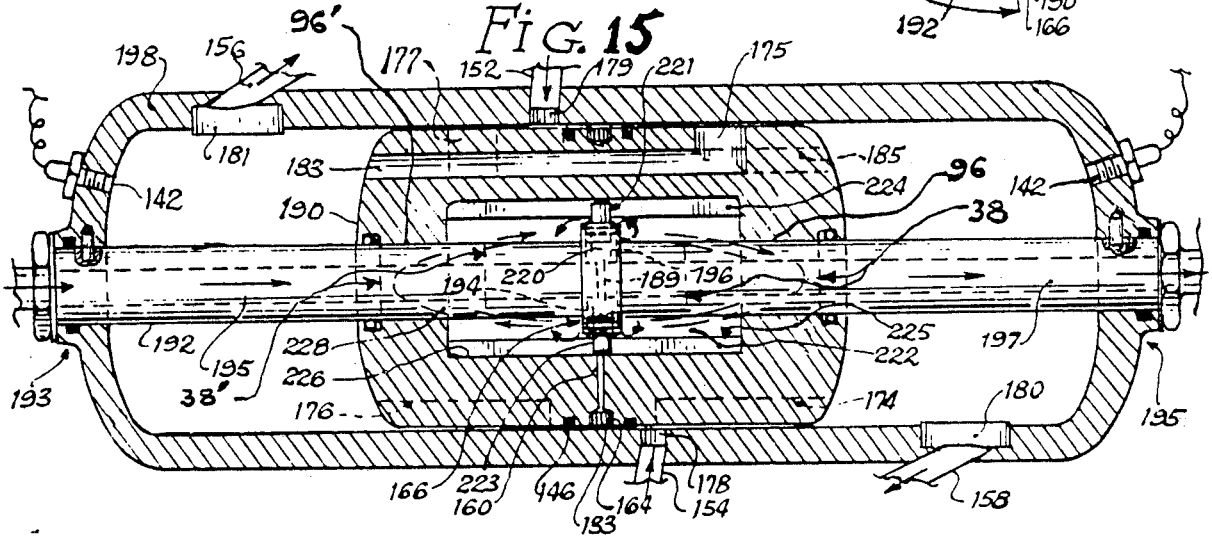
FIG. 15
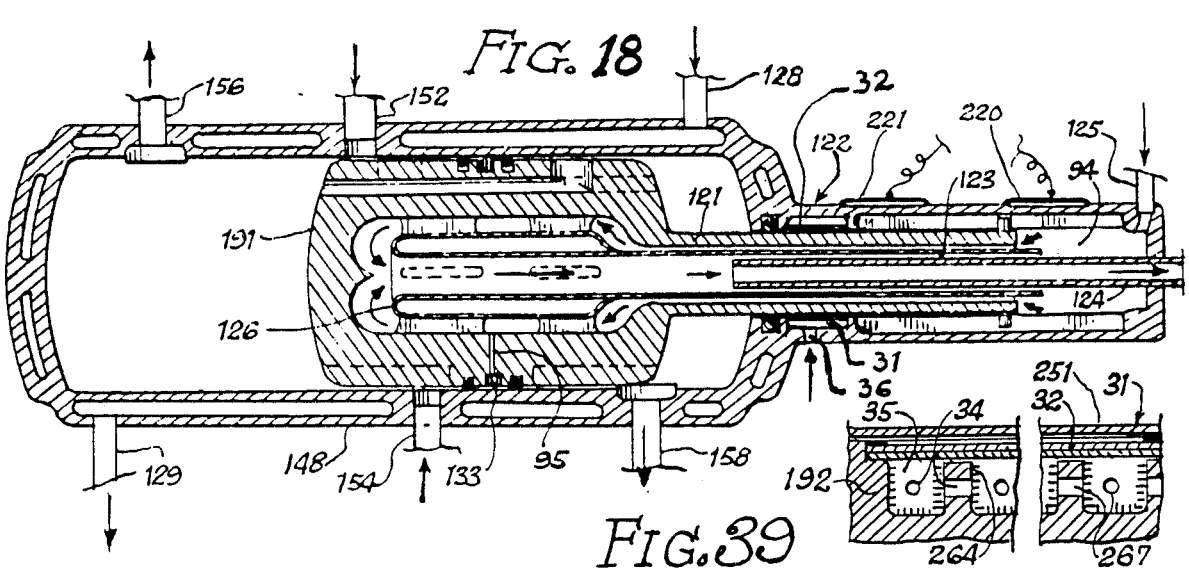
FIG. 18
FIG. 39

FIG. 19
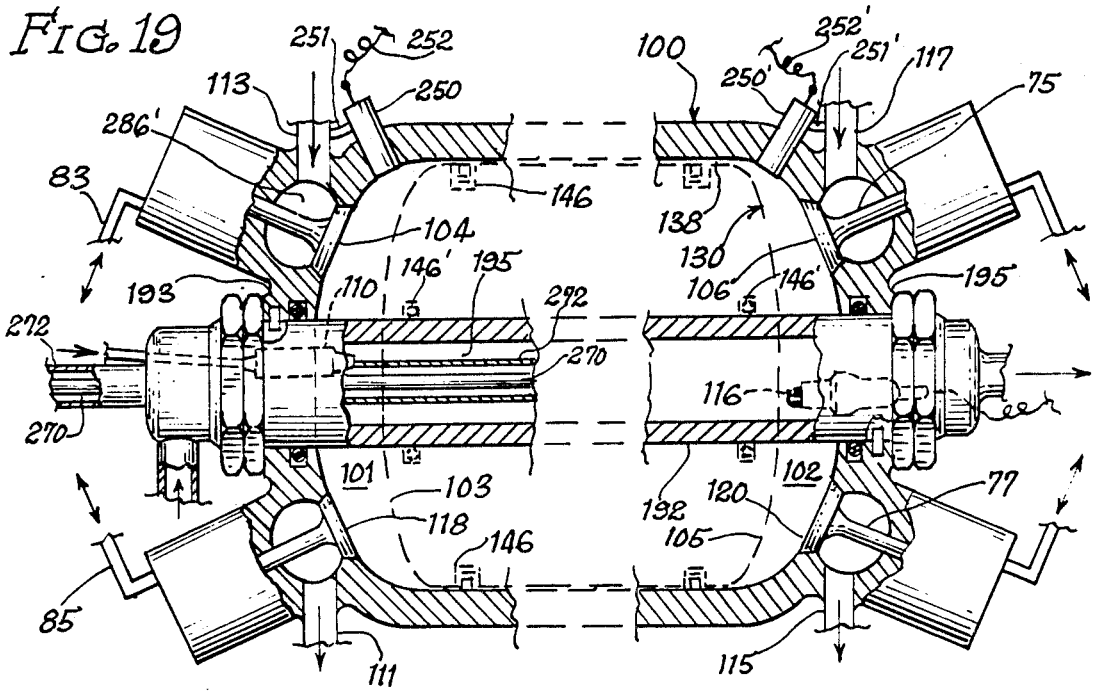
FIG. 21
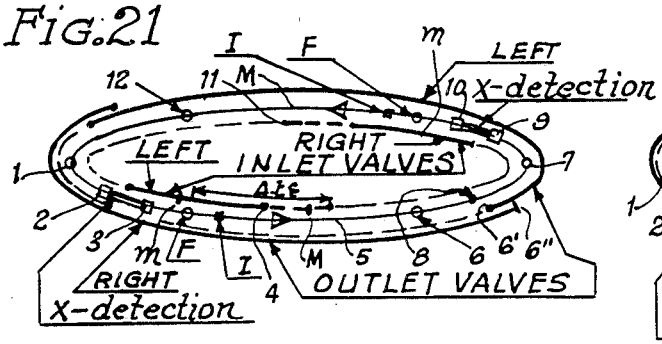
FIG. 20
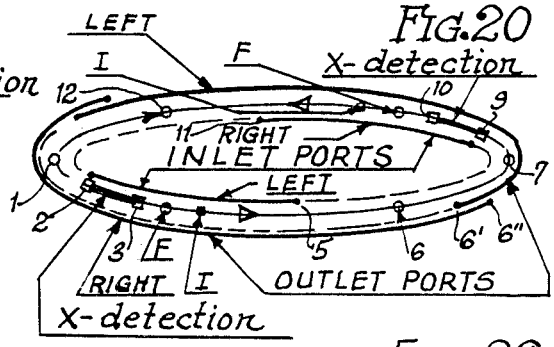
FIG. 22
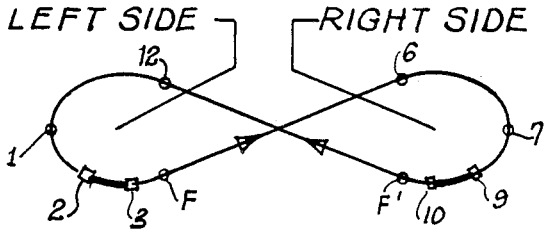
FIG. 36
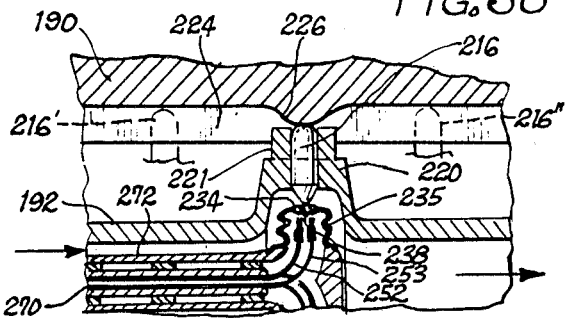
FIG. 28
START CYCLE
| STEP | | SEQUENCE | RESULT | STEP | SEQUENCE | RESULT |
|---|---|---|---|---|---|---|
| Switch | | ON / OFF | Time "0" | C.P.U. | ON / OFF | CYCLE CONTROL |
| VALVES | INLET / INTAKE | O / C | Storage | Starter | ON / OFF | Idle |
| VALVES | DUMP | O / C | TANK | Brake | ON / OFF | Combus- |
| VALVES | BY-PASS | O / C | FILLS | Ignition | ON / OFF | tion Mem- |
| VALVES | Exhaust | O / C | Variable | Fuel Inj. | ON / OFF | ber Starts |

METHOD OF CONTROLLING A FREE PISTON EXTERNAL COMBUSTION ENGINE

CROSS-REFERENCE TO RELATED APPLICATION

This application is a continuation-in-part of my prior U.S. patent application Ser. No. 586,812, filed Mar. 6, 1984, and entitled EXTERNAL COMBUSTION ENGINE, now U.S. Pat. No. 4,561,252.

BACKGROUND OF THE INVENTION

The present invention relates to an external combustion engine that combines the advantages of different types of piston and rotary engines into a single construction.

Conventional engines present significant cooling problems. Further, each type of engine, such as Otto Cycle, Diesel and gas turbine, is limited in its design possibilities by its principle of operation and its lack of flexibility in component arrangement. Particular fuels must be used for example.

Diesel and Otto Cycle engines produce undesirable vibrations and low frequency noise. Diesel engines require high compression ratios and are difficult to start. The typical engine requires a large number of complex moving parts. As a result, such engines are also heavy and bulky. Gasoline type internal combustion engines require highly volatile fuels. Although much lighter and less particular fuel-wise, turbine engines generate high pitch noises and require expensive and complicated fuel control mechanisms. They are not practical for the power ranges needed for automobile propulsion.

Efforts are continuously being made to develop new engines that are more efficient and less expensive to manufacture and operate. Recently, efforts on a large scale with rotary engines are evidence of these continuing efforts.

In view of this background, it is an object of the present invention to provide a new and improved combustion engine that combines the best features of different types of engines to produce an effective power plant that will operate equally well with various types of fuels.

It is another object of the present invention to provide a slower combustion to enhance combustion efficiency, to minimize air pollution with exhaust products and allow the use of less expensive, less volatile and of possibly non-fossil fuels such as methanol.

It is another object of the present invention to produce an improved power plant that is simple in construction with few moving parts and that lends itself to production techniques at relatively low cost.

It is another object of the present invention to provide a new and improved type of engine that runs smoothly and that has low noise and vibration levels.

It is another object of the present invention to provide a new and improved power plant that offers flexibility in design to accomplish varying objectives of efficiency in fuel consumption, weight and space reductions.

It is another object of the present invention to provide a new and improved engine that has low friction losses and can be easily and efficiently cooled.

It is another object of the present invention to provide a new and improved power plant wherein a heat echanger can be simply added to facilitate cooling and to increase efficiency, and also to serve as damping storage tank.

It is another object of the present invention to provide a new and improved engine wherein the motor member and the combustion member are mechanically segregated to allow the use of most optimum materials for the construction of the parts of each of these two members.

It is another object of the present invention to provide a new and improved power plant wherein the overall reliability is enhanced, the maintenance made easier and repair work rendered less complex and less expensive.

It is another object of the present invention to provide a new and improved engine wherein the vibrations transmitted to the engine mountings and the power shaft are minimized.

SUMMARY OF THE INVENTION

The above objects are retained by an external combustion engine utilizing an engine member including compression means in communication with separate external combustion means. The gases resulting from the combustion are passed from the combustion means into the expansion means to provide the compression means driving power and also useful shaft output power.

Accordingly, the present invention provides an engine in which the four principal functions: air compression, fuel combustion, heat exchange and gas expansion; are physically segregated. The combustion process is temporally independent from the operation of the air compression and power extraction means. The power drive and the piston are not mechanically connected. The regimes of operation of the fuel combustion process and of the power production process are fully independent of one another. The combustion process has more time to take place and is more complete, as compared to that of current car engines. There are no side loads applied on the sleeve by the piston.

DESCRIPTION OF THE DRAWINGS

FIG. 1 is a side elevation of the single piston version of the external combustion engine of the present invention.

FIG. 2 is an end view of the external combustion engine shown in FIG. 1.

FIG. 3 is a midsectional elevation of the engine member of the external combustion engine of the present invention.

FIG. 4 is a longitudinal midsectional view of the sleeve, combustion chambers and free piston of the combustion member of the external combustion engine of the present invention.

FIG. 5 is an enlarged view of an inlet port to the compression chamber of the engine section shown in FIG. 3.

FIG. 6 is an enlarged view of an outlet port from the expansion chamber of the engine section shown in FIG. 3.

FIG. 7 is an enlarged view of the compression chamber outlet and of the expansion chamber inlet ports of the engine section shown in FIG. 3.

FIG. 12 is a schematic view of the arrangement of the control valve and inlet valve of the combustion member.

FIG. 13 is a schematic view of the arrangement of the control valve and outlet valve of the combustion member.

FIG. 15 is a midsectional elevation of a combustion member assembly in which the free piston has no appendage and is guided internally, with piston and sleeve valving opening registering.

FIG. 16 is a perspective view of the external surface of the free piston shown in FIG. 15 illustrating the inlet and outlet valving operation.

FIG. 17 is a section of the combustion member with the free piston taken midway between the two combustion chambers.

FIG. 18 is a midsectional elevation of a combustion member assembly in which the free piston is equipped with only one appendage and in which the inlet and outlet valving is performed according to the externally guided free piston position.

FIG. 19 is a midsectional elevation of a combustion member assembly in which the inlet and outlet valving is performed by poppet valves mounted on the sleeve end closures and which are operated by signals representative of the piston location.

FIG. 20 is a diagram showing the path followed by the detecting sensor of the piston location during the piston travel and the detection points for the combustion member of FIG. 15.

FIG. 21 is a diagram showing the path followed by the detecting sensor of the piston location during the piston travel and the detection points for the combustion member of FIG. 19.

FIG. 22 illustrates an alternate path which the piston can be made to follow during its travel.

FIG. 23 shows an externally mounted valving system for use in conjunction with the combustion member assembly of FIG. 15.

FIG. 28 is a block diagram illustrating the starting system of an external combustion engine.

FIG. 29 is a block diagram illustrating the mode of operation required to be followed for stopping an external combustion engine free piston so as to position it properly for the next starting cycle.

FIG. 30 is a sectional view of the piston braking system of the combustion member shown in FIG. 15.

FIG. 31 is a sectional view of the piston braking system of the combustion member shown in FIG. 19.

FIG. 32 is a partial midsectional elevation of an inlet poppet valve shown with an air deflector attached and taken along section lines 32—32 of FIGS. 33 and 34.

FIG. 33 is an end view of an inlet poppet valve equipped with a compressed air deflecting arrangement.

FIG. 36 is a detailed sectional view of the piston location detecting sensor shown in FIG. 15.

FIG. 38 is a graphic representation of how the fuel-to-air ratio is set to vary as a function of power level, during steady state operation and during acceleration/deceleration periods.

FIG. 39 is a partial sectional view of the piston brake arrangement showing the extensible brake wall and its supporting structure.

DETAILED DESCRIPTION OF THE INVENTION

Figure 9:
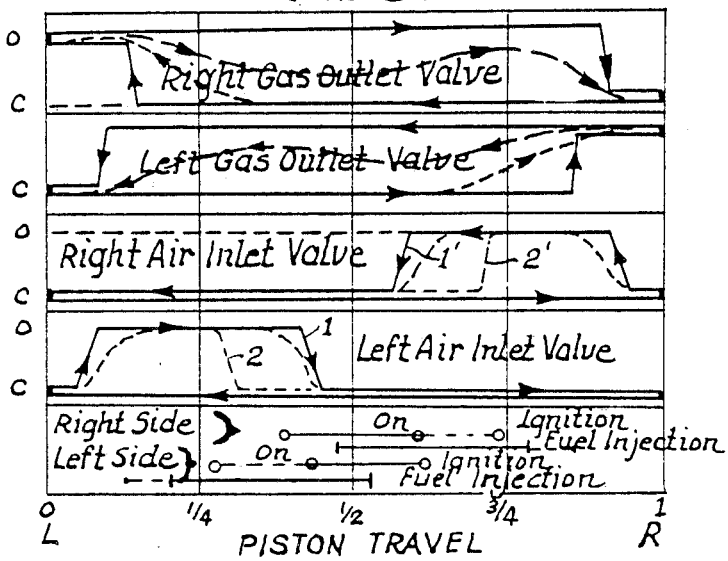
FIG. 9 is a timing diagram pertaining to the opening and closing sequences of the combustion member valves, and of fuel injection and ignition means operating sequences.

Referring to FIGS. 1, 2, 3 and 4 of the drawings, the external combustion engine of the present invention generally comprises in its simplest form an engine or power delivery member 1 coupled with a heat exchanger 30 and a free piston combustion member 100. The engine compresses the air in a compression chamber 3 and channels it to heat exchanger 30. From the heat exchanger, the air passes to either one of the two combustion chambers 101 and 102 located at each end of combustion member 100, depending upon the inlet valves 104 and 106 positions. The two combustion chambers are formed and separated by a free piston 130 sliding in a sleeve between the end closures thereof. Upon combustion of the fuel injected by means of fuel injectors 110 and 112, ignited by spark plugs 114 and 116, the combusted gases leave the combustion chamber through outlet valves 118 and 120. The gases then enter heat exchanger 30 where heat is exchanged between the combusted gas and the compressed air. The gases then leave heat exchanger 30 to be admitted into the engine expansion chamber 5 in which it expands to atmospheric pressure.

Air is admitted into the compression chamber through inlet duct 7, compressed by the displacement of a plurality of vanes 9 guided inside channels 11 inside a rotor 13 rotating in the direction of the arrows shown in FIG. 3. The air entrapped between the vanes is forced to occupy a smaller and smaller volume as the vanes move, thereby being compressed until the leading vane uncovers opening 15 connected to compression member outlet 17. The combusted gas leaving the heat exchanger enters the engine through admission duct 19 and enters the expansion chamber 5 through opening 21. As the rotor-vane assembly rotates clockwise, in the configuration shown, the volume occupied by the gas entrapped between two vanes increases and the gas inside the volume expands until opening 23 becomes uncovered by the leading vane, at which time, the expansion chamber vents to the atmosphere through exhaust duct 25 and the combusted gas leaves the engine. The expansion chamber is generally larger than the compression chamber and the mean pressure inside the expansion chamber is generally higher than inside the compression chamber. The result is more energy generated by the expansion member than is absorbed by the compression member. The energy difference is available on the rotor shaft 29 as useful power and represents a large fraction of the fuel energy.

The engine may have additional features as illustrated in FIGS. 1 and 3 in phantom lines. Some or all of the excess power referred to above can be extracted by bypassing compressed air or combusted gases for direct use separately from the engine by means of bypass valves 41 and 43 that may be controlled manually or electrically, automatically or at will as desired. The air compression efficiency, and thereby the engine overall efficiency, can be increased by injecting water or a water/methanol mixture inside the air inlet duct 7, by means of injector 45. The expansion chamber side of the engine is constantly exposed to hot gas and may need external cooling. This is achieved by means of a water cooling jacket 47, in which cold water enters through pipe 49 and exits through pipe 51. FIGS. 5 and 6 show how the openings 23 and 27 are shaped so as to provide continuous support to the sliding ends of vanes 9 as they become uncovered. FIG. 7 shows the shape of openings 15 and 21. The collecting ducts 61 and 63 shown in FIG. 2 facilitate the passing of compressed air and combusted gas between the engine and the heat exchanger, whenever the engine comprises two or more segments, such as that illustrated in FIG. 3, sandwiched together so as to keep the vane length-to-width ratio within the reasonable limits required for a satisfactory operation of the engine, even though the engine total length may be larger than its diameter. Each engine segment is separated from a contiguously located segment by a plate that may or may not provide intersegmental cooling and lubrication means. All rotors in all engine segments are mounted on one single shaft. The end of such shaft, opposite to the power shaft 29, is intended for driving accessories or receiving the starting torque needed to initiate the engine operation.

In FIG. 4, the free piston inside the combustion member has no direct physical connection with the exterior of the combustion member. However, the opening and closing of valves 104, 106, 118 and 120 must be synchronized with the free piston motion at any and all times. Free piston 130 is equipped with a ring 132 made with a material most suitable for detection. The combustion member is equipped with a plurality of sensors 134 connected to electrical pickup lead 136. The sensing mode used to detect the position of ring 132 may be of magnetic or sonic nature, depending upon the material used in the construction of the free piston and the combustion member wall. When the combustion chamber wall is made of non-ferrous materials, magnetic means can be used and ring 132 is made of magnetic material. Otherwise, ultra sounds can be used and ring 132 can be made of a material with a sound impedance much different from that of the combustion member wall. In any case, the passing of ring 132 in front of a sensor 134 causes a signal to be generated. It is sent to a master control 140 in which the free piston position is then constantly monitored and the piston instant velocity calculated. At the same time, a pressure sensor 142 mounted on the combustion chamber end wall senses the pressure inside the combustion chamber. That signal is also sent to master control 140 where that information is monitored and processed. The letters a, b, c, d, e and f indicate how the various ducts, electrical and fuel lines shown in FIGS. 1, 2, and 4 are interconnected. From the data processed by master control 140, signals are sent from master control 140 to synchronization box 148 where the various signals for fuel injection inititation, spark plug energizing, valve closing and opening, timing, sequencing and duration of fuel injection are originated. A fuel injection pump 144 driven by shaft 59 feeds fuel to the injectors. Gas leakage between the two combustion chambers is minimized by means of rings 146 mounted on the free piston, on both sides of ring 132. The combustion member wall can be cooled by means of a water jacket if and where desired.

Figure 10:
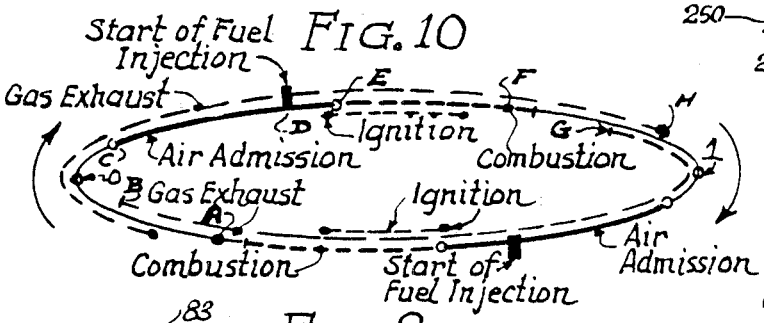
FIG. 10 illustrates the manner in which the combustion member valves, the fuel injection and the ignition means are sequenced, as shown in FIG. 9, when the sequencing is initiated by a combination of the axial and rotational motions of the free piston inside the sleeve.
Figure 8:
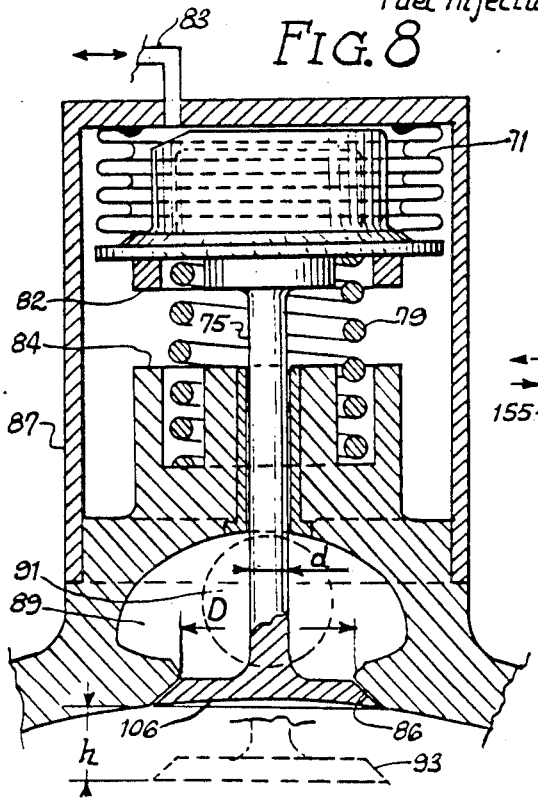
FIG. 8 is an enlarged sectional view of a typical inlet (or outlet valve) and of its actuation means shown in FIG. 4.

The valves shown in FIG. 4 are actuated by bellows 71 and 73 pressurized internally with a fluid such as oil. One face of these bellows is fixed and solidly connected to the combustion member structure. The other face is connected to the valve stem 75. A compression spring 79 maintains the valve on its seat and closed when the pressure inside the bellows is low. When the pressure is high, the bellows free face moves to push the valve open. Each bellows is connected to the oil pressure source by tubes 83 and 85. The double arrows of FIG. 4 correspond to the flow of oil as the high or low pressures are applied. A typical valve is shown in detail in FIG. 8 with the valve closed. With bellows 71 pressurized, stop 82 contacts stop 84 and the valve travels an amount h. The valve assumes the open position 93 depicted by a phantom line outlining the valve. The valve seat 86 offers a passage to air or gas of area $\pi(D^2-d^2)/4$ as seen in FIG. 8. The lateral air passage $\pi Dh$ should be at least equal to $\pi(D^2-d^2)/4$. With d small with respect to D and therefore negligible, h should be at least equal to D/4. When valve 106 is open, the combustion chamber communicates with valve chamber 89 that vents into duct 91. The bellows assembly is contained in and mounted on a valve housing 87 attached to the combustion chamber wall. The sequence of valve openings and closings is depicted in FIGS. 9 and 10, where the timing and duration of fuel injection and spark plug activation is also shown. The positions (O for open and C for closed) assumed by the four valves are indicated as a function of piston travel from the left side of the combustion chamber to the right side, and then back. The starting point of a typical cycle is shown by point O on the thin line ellipse of FIG. 10 and the end of one stroke is designated as point 1. L is for left side and R is for right side in FIG. 9 so as to correspond to the left hand and right hand sides of FIG. 4. In FIG. 10, the piston motion is illustrated as imagining one point of reference on the piston describing or following an imaginary ellipse for ease of understanding, as though the piston were subjected to an oscillating lateral motion synchronized with its longitudinal travel. As seen from examining FIGS. 9 and 10, it is apparent that the two air inlet valves are never open at the same time, but the gas outlet valves are sometimes open at the same time. This is required to supply gas to the engine at a flow rate and pressure as evenly as possible. However, the gas outlet valves are never both closed at the same time, as a corollary result. For this reason, the controls of the air inlet and gas outlet valves are different, but such that only one control valve is needed for each set of air inlet valves and gas outlet valves.

Figure 14:
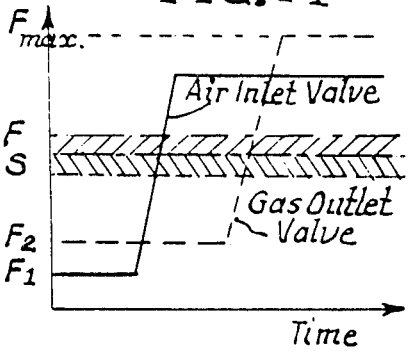
FIG. 14 illustrates the manner in which the forces acting on the inlet and outlet valves are applied chronologically.
Figure 11:
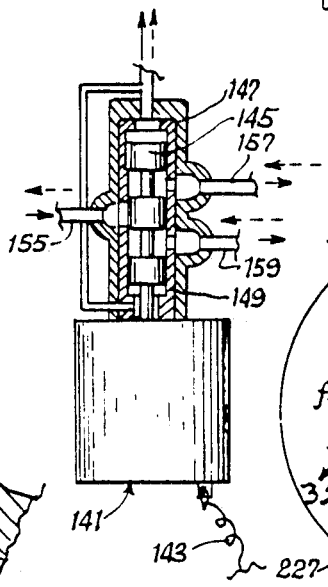
FIG. 11 is a midsectional elevation of the control valve used to monitor the opening and closing of the inlet and outlet valves of the combustion member.

The oil pressure inside all valve bellows is monitored by a control valve such as shown in FIG. 11. The control valve 141, actuated when electrical line 143 is energized, has 3 positions: neutral (position shown by pilot valve 145 in FIG. 11), up (when pilot valve 145 moves to stop 147) and down (when pilot valve 145 moves to stop 149). In the neutral position of pilot valve 145, control valve 141 is not energized; in the up and down positions, control valve 141 is energized, but with an inversion of polarity, in one instance as compared to the other. The arrows of FIG. 11 are shown either in solid line or in dotted line. The direction of the arrows indicate how oil pressure is applied to or from the control valve. The solid line arrows refer to the use of such a control valve to monitor the air inlet valves. The dotted line arrows refer to the use of such a control valve to monitor the gas outlet valves. In both cases, a hydraulic potentiometer is used by means of a restricting orifice as shown in FIGS. 12 and 13. FIG. 12 pertains to the actuation of the air inlet valves and FIG. 13 pertains to the actuation of the gas outlet valves. In FIG. 12, the oil passing through the restricting orifice 151 is either flowing or stopped depending upon control valve 141 being open or closed. When closed, the full oil supply pressure is applied inside bellows 71; when open, the low return oil pressure is felt by bellows 71, on account of the large pressure drop through restricting orifice 151. Only one bellows at one time needs feel the full oil pressure. This is accomplished by connecting line 157 of control valve 141 in FIG. 11 to one air valve bellows and line 159 to the other air valve bellows, with restricting orifices 151 on each line installed downstream of the connection. In FIG. 13, again, each line 157 and 159 is connected to one gas valve bellows, but restricting orifices 153 are located upstream of these connections and the oil flow through the control valve is inverse of what it is for the case of the air inlet valve bellows actuation. In FIGS. 12 and 13, the oil lines connecting the other bellows in a parallel loop are shown and identified as 161, 163, 165 and 167. It should be pointed out that: when the free piston reaches the end of each stroke (minimum volume inside the combustion chamber), both valves venting that combustion chamber are closed. Both valves venting either combustion chamber are never open at the same time, but can be closed at the same time. When any valve is open into a combustion chamber, air flows from valve chamber 89 into the combustion chamber and combusted gas flows from the combustion chamber into valve chamber 89. This means that, to open, the air valves do not have to counteract a pressure force acting to keep them closed, but, on the contrary, to open them. However, the gas valves must counteract a pressure higher in the combustion chamber than it is at that time in the valve chamber. This situation is somewhat alleviated by the fact that the minimum and maximum oil pressures inside the gas valve actuating bellows are always higher than those felt inside the air valve actuating bellows. This is illustrated by the graphs of FIG. 14 which show the forces acting on the valve stems due to bellows pressures and spring forces, during the opening phase as a function of time. The force $F_s$ corresponds to the force exerted by the spring at mid-opening position of the valves. The shaded areas correspond to the spring force variations with valve travel. Gas outlet valves have larger forces available to open than do air inlet valves. This results from the fact that if the various pressure levels available and the pressure drops across the restricting orifices and the pilot valves are as follows:

$P_{max}$→Max. oil pressure level available upstream of any first restriction in oil feed line;

$P_{min}$→Oil return line pressure downstream of all restrictions;

$\Delta P$→Pressure drop across any restricting orifice; and $\delta P$→Pressure drop across the restriction presented by the pilot valve;

then, the maximum pressures ever felt inside the air and gas bellows are:

Air valve bellows max. pressure level $= P_{max} - \Delta P$

Gas valve bellows max. pressure level $= P_{max}$ (no oil flow)

and, the minimum pressures ever felt inside the air and gas bellows are:

Air valve bellows min. pressure level $= P_{min}$ (no oil flow)

Gas valve bellows min. pressure level $= P_{min} + \delta P$

The proper selection of $\Delta P$, $\delta P$, spring force, valve size and maximum oil pressure level permits the use of identical parts for all valves, thus resulting in similar operating characteristics for both air and gas valves. Only the control valves, restricting orifices and bellows connections are arranged in a different manner.

The free piston shown inside the combustion member of FIG. 4 is subjected to no external forces, except for those resulting from the pressure felt inside both combustion chambers. The piston has no direct, physical or solid connection with any other component. This has the advantage of letting the piston select its angular position within the sleeve of the combustion member, which may not result in the best selection always in terms of wear patterns. The disadvantages are numerous, such as lack of: piston cooling means, piston lateral guiding means for preventing the piston from getting into a detrimental wear pattern, positive and automatic means for connecting the piston and valve positions, direct means for generating signals for initiating the fuel injection and/or the spark plug activations. Therefore, it is desirable to remedy such discrepancies in ways such as those illustrated in the combustion member configurations presented in FIGS. 15–31.

The first alternate combustion member embodiment is presented in FIGS. 15 to 18, in which the use of poppet valves for air and gas valving in and out of the combustion chambers is eliminated. Air and gas valving is done automatically by means of openings in the piston, 175 and 177 for air, 174 and 176 for gas, that match and register with ports in the sleeve, 178 and 179 for air, 180 and 181 for combusted gas. Air ducts 183 and 185 connect the openings 175 and 177 to their respective combustion chambers. In FIG. 15, the lateral locations around piston 190 outer surface are not correct, although located correctly longitudinally, for simplification sake. The perspective view of piston 190 in FIG. 16 and the cross-section shown in FIG. 17 indicate how the openings in the piston and the ports in the sleeve are located with respect to each other, both laterally and longitudinally. As previously described, an oscillatory motion is imparted to piston 190 which results in an elliptical curve on the developed internal surface of sleeve 198 as would be traced by any point located on piston 190 outer cylindrical surface. The result of this relative motion between the piston inside the sleeve is a set programmed sequence of piston openings registering with their corresponding ports in the sleeve, as the piston moves back and forth, oscillating in the process, as indicated by the solid lines of the graphs of FIG. 9 where the word valve now refers to the valving operation instead of the poppet valve system.

Piston 190 is hollow and slides on a hollow stem 192 as illustrated in FIG. 15. Stem 192 is rigidly mounted on the combustion chamber dome walls. The inside of stem 192 provides for lubricating and cooling oil to be channelled inside piston 190 by a plurality of ducts such as 194 and 196 to vent the oil in and out of piston 190 internal cavity. Ducts 195 and 197 inside stems 192 are not connected directly and a wall 189 located between ducts 194 and 196 separate them. Arrows indicate the path that the cooling and lubricating oil is forced to follow. Midway between each of stems 192, a cylindrical flange 220 protrudes externally to stem 192 and is solidly attached to it. This flange contains ducts 194 and 196, and its outer cylindrical surface fits inside cylindrical surface 225 of cavity 222 inside piston 190. Two diametrically opposed guiding stubs 221 and 223 are mounted on flange 220. These stubs engage elliptically curved grooves 224 and 226 cut on surface 225 inside piston 190 wall. The length of the major axis of the centerline ellipse of these grooves, located on surface 225 and diametrically opposed, is equal to and determines piston 190 strokes. The length of the minor axis of that ellipse, as shown on a flat developed view of cylindrical surface 225, determines the degree of piston oscillating motion as indicated by angle $\alpha$ of FIGS. 16 and 17. The ellipse shown in phantom line inside cavity 222, within angle $\alpha$ of FIG. 17, shows graphically piston 190 motion. It corresponds to the projection of FIG. 15 ellipse, also shown in phantom line. The sections shown in FIGS. 15 and 18 are along the centerline of one half of such ellipses and their corresponding grooves are shown as a set of straight cut grooves in these figures for the sake of clarity. Lubrication of piston 190 is achieved by means of the lost oil process, whereby oil used for lubrication leaks out and burns in the combustion chamber. The end surfaces of stubs 221 and 223 are neither flat nor spherical, but cylindrical in shape, with the axis of such cylinder being perpendicular to the plane of FIG. 15, so as to produce a wedge effect (such as that obtained with journal bearings). This momentarily raises the oil pressure locally when stubs 221 and 223 pass in front of oil ducts 160 that are located at the bottom of guiding groove 226, midway between its two guiding walls. Also, the sliding outer surface of flange 220 is slightly chamfered on both sides to produce the same wedge effect against surface 225. A plurality of holes 162 are also provided to connect swiping and lubricating rings 133 housing groove 164 with cavity 222. Each time piston 190 passes through its mid-stroke position in either direction, the groove housings of rings 133 receives a small amount of lubricating oil. To insure that the back and forth motion of piston 190 is not unduly slowed down by the oil flow required from one side of flange 220 to the other, as piston 190 travels from one end of cavity 222 to the other end, a plurality of holes 166 drilled through flange 220 establish ample passage for the oil. In FIG. 16, cavity 222 and stem 192 are omitted for the sake of clarity. Air ducts 183 and 185 could be curved as indicated in phantom line so that the air exits into the combustion chamber at an angle, as shown by arrow f, to create the vortex mentioned for FIGS. 32 to 34. Air ducts 152 and 154, and gas ducts 156 and 158 connect the sleeve ports to the heat exchanger.

The piston/combustion-member assembly shown in FIG. 18 is a variant of the above described embodiment and incorporates a set of telescoping appendages 121 and 122 attached to piston 191 and one combustion chamber end closure. A telescoping tube assembly 123 located inside appendage 121 channels the cooling and lubricating oil out to outlet line 124. The oil is introduced into chamber 94 where it lubricates the guiding stub and groove assembly at the end of appendage 121 and flows between appendage 121 wall and the outer surface of telescoping tube assembly 123. An oil channelling arrangement 126 guides the oil along the internal surface of piston 191, for cooling purpose. A plurality of ducts 95 connect the piston internal surface to the groove of the lubricating ring. In this configuration, duct 95 can be fed lubricating oil at a pressure much higher by means of of another telescoping tube arrangement not shown, but located concentrically with and inside telescoping tube assembly 123. The guiding stub-groove assembly imparts to piston 191 the elliptical type of motion previously described. Piston 191 position and direction are again detected, as in FIG. 4, by sensors 220 and 221, for initiating fuel injection and spark plug ignition. A water cooling jacket 148 receives coolant through pipe 128 and it exits through pipe 129. The working of air and gas openings and ports is the same as described previously.

For reasons discussed in the next section, it is important to stop the piston within a specific portion of its stroke, and to maintain that piston position until restarting the engine, as the engine operation ceases. To that effect, a piston brake system 31 is provided as shown in FIG. 18 (or 38 and 38' as shown in FIG. 15). In the embodiment of FIG. 15, the brake system is located in the wall of guiding shaft 192 and applies pressure on the internal sliding lands 96 and 96' of piston 190 when hydraulic pressure is applied inside cavity 35 (FIG. 39). An enlarged partial sectional view is presented in FIG. 30 and indicates how pressurizing oil is ducted through duct 169 into cavity 35 by means of opening 97. In the embodiment of FIG. 18, the brake system 31 is located in the wall of female appendage 122 next to the sleeve end closure and applies pressure on the external sliding surface of piston stem 121 when hydraulic pressure is applied inside cavity 35. In this piston embodiment, only one brake system is required to stop the piston in any position, whereas two brake systems are needed in the case of FIG. 15. An enlarged partial sectional view of brake system 31 is presented in FIG. 31 where oil under pressure is introduced into cavity 35 by means of openings 36 and oil duct 172, when the brake is applied. When such is the case, the extensible wall 32 bulges out in the direction the pressure is applied so as to exert pressure on the structure in direct contact at that time, i.e. stem 121 or piston 190 internal sliding lands (96 or 96'), as the case may be, thereby providing the braking and stopping action. FIG. 39 shows in more detail the construction of the extensible wall of the brake system. Wall assembly 32 consists of a coiled band located between thin wall 251 attached to shaft 192 (supporting body) and structure 264 which consists of a grid of interconnected webs and ribs fixedly attached to body 192. The coiled band provides longitudinal rigidity while allowing some radial motion. Narrow longitudinally-oriented slots are cut in thin wall 251 so as to permit the bulging out effect mentioned previously. Holes 267 in the webs and the ribs enable the free flow of hydraulic fluid throughout cavity 35. In the piston embodiment of FIG. 15, wall assembly 32 must not deform inwardly when exposed to either gas pressure or lubricating oil pressure, as piston 190 moves back and forth when the brake is not applied. Structural grid 264 assumes this supporting role then. Although the brake system extensible wall does not perfectly seal cavity 35, it is immaterial in FIG. 18 configuration and of little importance in the case of FIG. 15 configuration. In the latter case, a minimum amount of hydraulic fluid may enter a combustion chamber where it is later burned. As discussed in the following section, the amount of braking action required is minimal and only during a very short time. When the engine is not operating, a more positive action can be used for keeping the piston locked in place.

Another alternate embodiment of the combustion member is presented in FIG. 19 in which piston guiding and valving by means of poppet valves are combined. The valving system is that already described in FIG. 4, the internal guiding shaft is that just described in the case of FIG. 15 and the piston is also caused to oscillate as it reciprocates. However, the valving vents and ports cut into the piston and the sleeve as shown in FIG. 15 are not present in the latter embodiment. The internal construction of the piston and its cooperating action with shaft 192 are identical and therefore omitted in FIG. 19. Shaft 192 extends from one end closure to the other and is fixed thereto. Fuel injectors such as 110 and spark plugs such as 116 (shown in phantom lines) are located in a plane substantially perpendicular to that of FIG. 19. Two pressure pick-up transducers 250 and 250' are mounted to detect the compressed air pressure in the combustion chambers and send their signals by means of leads 252 and 252' respectively. The piston cooling and lubricating oil is ducted through hollow shaft 192 as previously described. The piston location inside shaft 192 as depicted in FIG. 36 and the representative signals are channelled by means of cable 270 housed in protecting sheath 272. The positions of the piston at the ends of its stroke are shown in phantom lines 103 and 105. The poppet valves 104, 106, 118 and 120 are actuated hydraulically as previously described for FIGS. 4, 8, 11, 12, 13 and 14.

Figure 35:
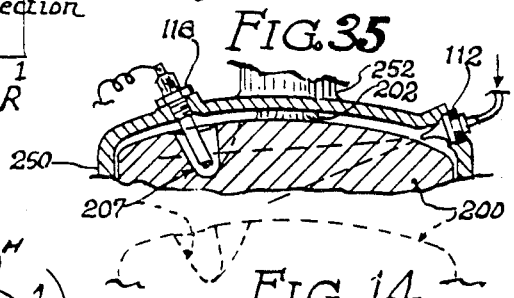
FIG. 35 is a developed sectional view taken along section line 35—35 of FIG. 34.
Figure 34:
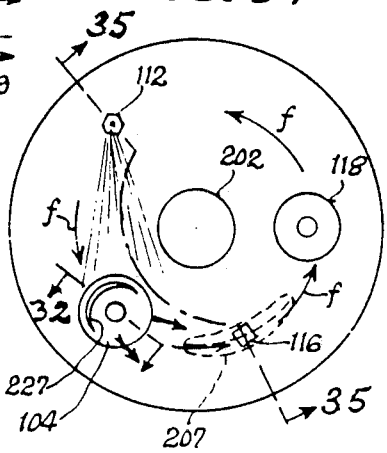
FIG. 34 is an end view, as seen from inside a combustion chamber, of the combustion member sleeve end closure.

In comparison with the embodiment of FIG. 4, the presence of shaft 192 and of its attachments to the sleeve closures necessitates moving the spark plug and fuel injector locations around the shaft mountings and creating a solid body inside the combustion chambers. It is then advantageous to generate a swirling movement of the mixture of compressed air and injected fuel around the shaft to facilitate the combustion process, and initiation thereof, by causing the mixture to flow by the spark plug. This can be easily performed by fitting the inlet valve with a deflector 227 such as shown in FIGS. 32 to 34. A direction is thus imposed on the vortex generated by the introduction of the air through the inlet valve. FIG. 34 indicates how the inlet valve, the fuel injector and the spark plug may be relatively positioned so as to optimize the benefits of such vortex action. It is also advantageous to position the spark plug as deeply as possible into the combustion chamber. Because the piston rotates as it reaches the end of its stroke, FIGS. 34 and 35 illustrate how a crescent-shaped cavity formed in each of the wall of piston 130 ends can accommodate such spark plug positioning, without causing risks of mechanical interferences.

In the combustion member configuration of FIG. 19 in which poppet valves are used, means must be provided for relating the valve operations to the piston motion and location inside the sleeve. Electrical sensors such as 134 of FIG. 4 or 220 and 221 of FIG. 18 can again be used. However, because the piston is in constant contact with a fixed internal body (shaft 192), it seems advantageous to detect the relative positions of the piston with such shaft directly and continuously, as FIG. 15 illustrates. To that effect, two oppositely located stubs 221 and 223 house two pins 216 which can slide inside flange 220. The bottom surface of cooperating grooves such as 224 which guide the stubs is not flat but has bumps such as 226 jutting inwardly and which make contact with one end of pins 216. The other pin ends push on the end structure of a bellows 235 which seals the sensor internal volume and provides the spring action needed to insure permanent contact of the pin with groove 224 bottom.

At intervals during their travels along the cooperating guiding grooves, bumps such as 216 are encountered by the pins, the pins are caused to move inwardly and bellows 235 are compressed. This motion causes the end of the bellows to establish electrical contact between leads 252 and 253. An electric signal is then generated and sent through cable 270 to the input ports of a central processing unit (CPU) which handles such incoming signals. The locations of such bumps and the duration of the electrical contact, dependent upon the length of the bump, constitute the signal information that is used to determine the piston location and eventually velocity. Such piston information data is graphically represented by the diagrams of FIGS. 20 and 21. FIG. 20 corresponds to the combustion member embodiments of FIGS. 15 and 18. FIG. 21 corresponds to the combustion member embodiment of FIG. 19. The elliptical paths of the guiding stubs shown by the mid-ellipses correspond to the locii of the stub positions on the developed surfaces into which the grooves are cut. Another possible type of curved path can be programmed for the stubs by having the grooves cut to follow a lemniscate-type curve, as depicted in FIG. 22. Such curve offers the advantage of minimizing the risk of the piston and the sleeve developing wear patterns which could only prove detrimental to the life of the engine. Also, the piston rotates twice as much per stroke, as compared to the ellipse case. Furthermore, the piston kinetic energy in the translation mode is more easily converted into rotational kinetic energy, and vice-versa, at the end of each stroke, putting less stress on the guiding stubs and their grooves. At the locations where the piston velocities are the highest, the piston thus requires little angular acceleration or deceleration.

Figure 24:
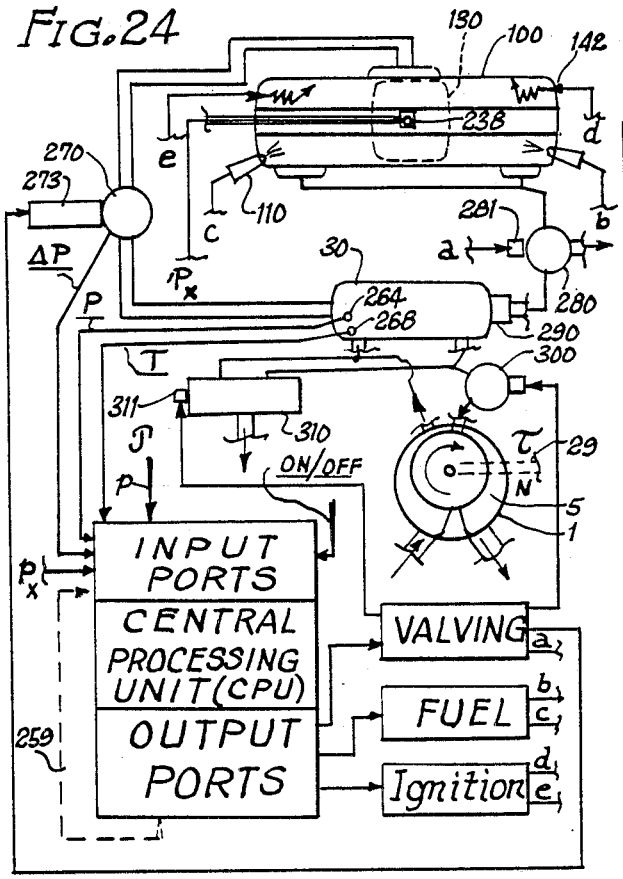
FIG. 24 is a schematic diagram of an external combustion engine operated by the automatic valving arrangement of FIG. 15.
Figure 26:
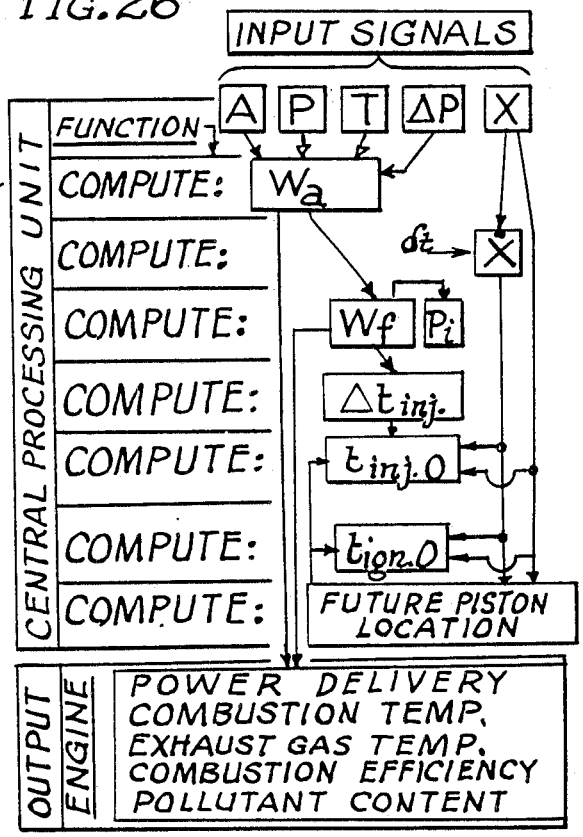
FIG. 26 is a block diagram depicting the operation of an external combustion engine utilizing FIG. 15 combustion member.
Figure 25:
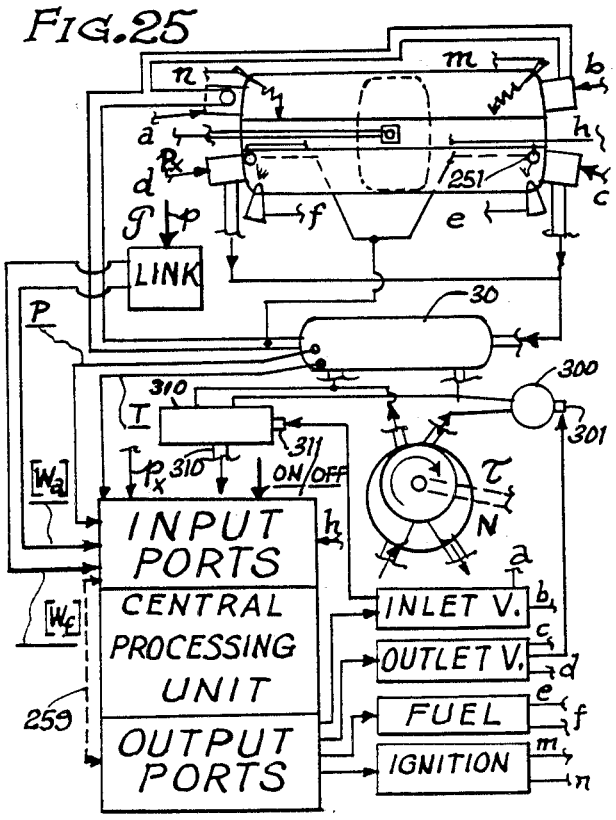
FIG. 25 is a schematic diagram of an external combustion engine operated by the poppet valve arrangement of FIG. 19.
Figure 27:
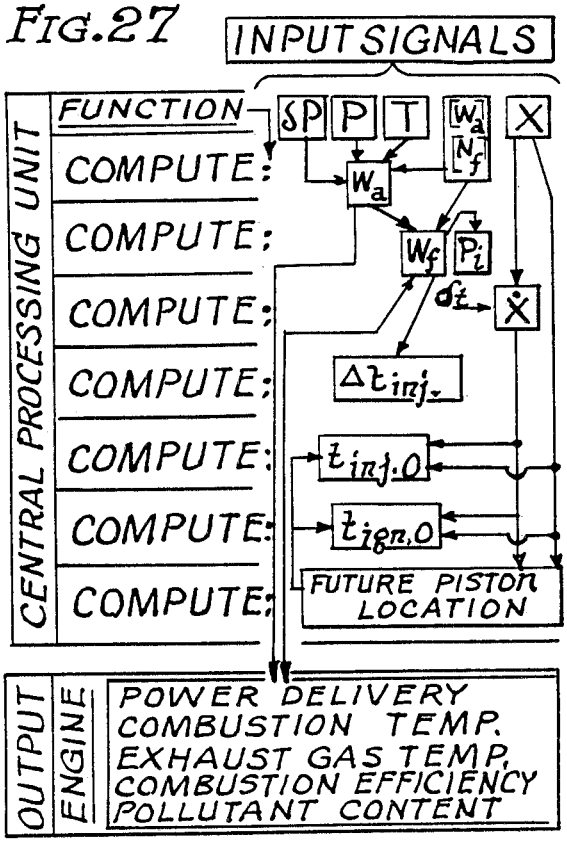
FIG. 27 is a block diagram depicting the operation of an external combustion engine utilizing FIG. 19 combustion member.

FIGS. 24 and 26 schematically represent the operation and the control thereof of an engine under quasi steady state running conditions. FIG. 24 indicates how and where the various control signals are generated for an engine equipped with a combustion member such as those of FIGS. 15 or 18 (fixed valving). FIG. 26 indicates the nature of these signals and how they are processed by the CPU. FIGS. 25 and 27 correspond to an engine equipped with a combustion member such as that of FIG. 19 (valving by means of poppet valves, adjustable timing). FIG. 25 indicates how and where the various control signals are generated. FIG. 27 indicates the nature of these signals and how they are processed by the CPU. The control aspect of these engine embodiments are fully discussed in the next section.

As demonstrated in the following section, for all engine embodiments incorporating either type of combustion members, it is desirable to simultaneously adjust fuel and compressed air deliveries to the combustion chambers so as to prevent the combustion temperatures from reaching their highest possible theoretical values. The admission of compressed air in the combustion chambers, in the case of the combustion member embodiments of FIGS. 15 or 18, is not adjustable by means of the inlet ports which have a fixed timing, being a function only of the piston position and velocity. The amount of air admitted cannot be directly monitored, unless some additional valving means is provided. FIG. 23 illustrates an air intake valve system constructed to achieve that end. In that figure, other valves are also shown for operation during the engine starting and stopping cycles. They are all described hereunder. The overall valving system consists of an air intake valve 270 located between the heat-exchanger/storage-tank 30 and combustion member 100, a by-pass valve 280 connecting combustion member 100 to tank 30, a shut-off valve 300 located between tank 30 and engine 1, and a dump valve 310 connected to both the compressed air duct and the combusted gas duct connecting the storage tank to the engine 1. A check valve 290 is located between by-pass valve 280 and storage tank 30.

Compressed air intake valve 270 adjusts the area A between a plunger 271 and a Venturi orifice 272. The displacement x of the plunger determines the value of A and is monitored by actuator 273. The air pressure differential $\Delta P$ between the Venturi throat and a downstream location where the air flow is less turbulent is detected and used to establish the air flow rate through the Venturi throat. During engine operation, by-pass valve 280 stays closed and the combusted gas flows through it unaffected. When actuated into the open position by actuator 281, the combusted gas flow out of the combustion member is vented to the outside. Check valve 290 then prevents the combusted gas contained in storage tank 30 from being vented out also. Dump valve 310 is used to vent the contents of storage tank 30 outside when the engine is shut down. Actuator 311 then causes piston 318 to slide to the right, which registers openings 312, 313, and 316 in the sleeve with their corresponding channel openings 314, 315 and 317 in the sliding piston, shown in the dumping position in FIG. 23. When piston 318 is moved to the left, the registering ceases and the dump valve closes all openings. The dump valve is used to insure that no hot gases at high pressure are left in the storage tank indefinitely after the engine operation has ceased.

FIGS. 28 and 29 indicate the sequence and relative duration of the steps taken to start and stop an external combustion engine in which a free piston combustion member is used. The significance of the information shown in the two charts is discussed in the following section. A dump valve and by-pass valve 301 are used in all engine configurations incorporating the three embodiments of the combustion members presented in FIGS. 15, 18 and 19. In the case where the combustion member of FIG. 19 is used, by-pass valve 280 and check valve 290 are not needed if and when their functions are performed by modifying the mode of operation of the combustion chamber outlet poppet valves which can then be made to remain open, if a three-way valve is then connected to and between the combustion member and the storage tank. This approach does not satisfy the operational conditions of the automatic valving means of the embodiments of FIGS. 15 and 18 for which the opening and closing of the outlet valves are fixed.

OPERATION AND DISCUSSION

In the previous section, three basic embodiments of the combustion member are described, all based on the use of a free piston sliding inside a sleeve between two end closures which form two combustion chambers in cooperation with the ends of the free piston, as it reciprocates between these end closures. The first embodiment described in FIGS. 1 to 14 is used in this disclosure as a basic model for explaining the general operation of a free piston external combustion engine utilizing a vane motor as compressor, gas expander and power delivery system. The piston is totally free and no mechanical linkage comes into contact with said piston, at any time. The other basic embodiments all incorporate mechanical means for causing the piston to rotate as it reciprocates inside the sleeve, according to a set pattern. This enables the the piston movements to be used as direct means for initiating and timing all other operations incidental to the piston motion but essential to its control and to that of the combustion member operation. The understanding of the operation of the last two basic embodiments can then be directly deduced from the understanding of the operation of the first embodiment of principle. It is therefore discussed first, as model.

Basic Embodiment of Principle:

First, a starter connected to accessory drive shaft 59 is used to start the engine. It is energized and the rotor-vane assembly begins to rotate, compressing air which accumulates in heat exchanger/storage tank 30. A master control 140 signal causes all valves to remain closed. After a short time, one air inlet valve is caused to open and the gas outlet valve on the opposite side in combustion member 100 is caused to open. Piston 130 then moves in a known direction and its movement is detected and monitored by master control 140. At the appropriate time, before the piston full stroke is completed, with the piston moving in the correct direction, master control 140 automatically switches to normal operation. Fuel is injected as required, all valves start opening and closing sequentially as programmed. The spark plug operation is activated and on the subsequent return stroke of the piston, the starting procedure is completed. In engine constructions where the direction of the piston is unimportant, the chance of the piston starting to move in any direction is even. For engine constructions in which the piston must start moving in the correct direction so that the proper cycle sequencing is initiated, the piston can first be automatically positioned and held there at the initiation of the starting cycle by means of the inlet valve being so ordered by a master control 140 command.

Starter assistance may still be kept on for a few subsequent cycles. Such a starting operation bears more resemblance to the starting operation of a gas turbine than to that of an internal combustion engine. By adjusting the amount of fuel injected and the opening time of the air inlet valves at their lowest limits, idling speed is set. To obtain a higher power level, more fuel is injected per cycle and more air is concomitantly admitted in the combustion chambers by letting the air inlet valve remain open during a longer portion of piston 130 stroke, as indicated on the graphs of FIG. 9. It is possible to operate the present invention engine in such a way that air/fuel mixture ratios vary considerably less than is the case for gas turbines and internal combustion engines, during acceleration periods. The fact that energy in the form of compressed air is accumulated and stored in the heat exchanger, and is instantly available, makes the response to a demand for more power smoother and swift. Engine deceleration, on the contrary, may be less quick for the same reason, unless means are provided by the master control to override the normal operation of the gas outlet valves, when control valves are used for their control. Of course, the volume allocated to combusted gases in heat exchanger 30 can be made smaller than the volume occupied by compressed air. To stop the engine, fuel injection is shut off and spark plug activation is turned off.

Figure 37:
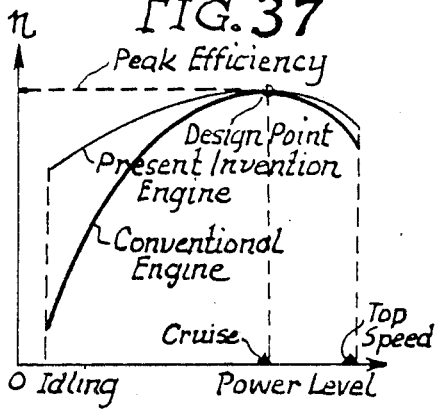
FIG. 37 is an engine efficiency chart showing a performance comparison between the external combustion engine of the present invention and a conventional piston engine at various levels of power setting.

As compared to conventional internal combustion engines in which the vehicle is directly and mechanically connected to the piston motion, whenever the clutch and gearbox are engaged, in the present invention, the vehicle can never be directly and mechanically connected to the energy-generating means (combustion member). The only connection is by means of a compressible fluid medium which offers flexibility of use and provides both compliance and energy storage capability. The inertia of the engine moving parts, per unit of power, is comparatively small, certainly much smaller than that of internal combustion engines, specially Diesel engines. Because the engine and the combustion member are not mechanically connected, the size of one component and its velocity, or operating regime, as selected for maximum efficiency neither influences nor dictates the size or the operation regime of the other component. For instance, the engine could be operating at 6,000 rpm and the piston of the combustion member could be operating below 10 cps. To optimize combustion efficiency and permit the use of inexpensive but non-polluting fuels that could reduce atmospheric pollution levels, relatively oversized combustion chambers and a slower moving piston can be combined with a fast rotating engine, as in the mentioned example. The temporal requirements for efficient air compression and expansion are the reverse of those needed for efficient combustion. In gas turbines and internal combustion engines, a compromise must be arrived at and in such resulting manner that neither process is optimized. The power plant of the present invention requires no such compromise, and each component can be optimized separately, then coupled with the other. The end result is a power source that is light, more efficient and less expensive to operate. Even if one assumes that, at the design point, the overall efficiency of the external combustion engine is no higher than that of an internal combustion engine, as illustrated by FIG. 37 graphs, for any off-design point operation, its overall efficiency would be higher for all off-design operating points. This is due to the fact that, at any and all regimes and operating conditions, each component can be programmed to operate at its peak efficiency. The possibility to decouple the mechanical linkage between the two basic components of an external combustion engine is essential. This is especially true for low power levels. The decoupling mentioned above and the resulting mechanical flexibility provides the advantages that additional gears in the gearbox, for automobiles, would offer. Mechanical decoupling of the two basic engine components also means physical decoupling. This presents additional advantages.

The two major components need not be built with the same or compatible materials. The materials best suited to meet the requirements for each part can be selected. For instance, new and better high temperature resistant materials are becoming available and their use is now being considered in the fabrication of some parts of internal combustion engines. An experimental Diesel engine constructed with parts made out of ceramics has been constructed and tested in Japan. It was built by Isuzu Motors and Kyoto Ceramics working in conjunction. It was reported by the press (August 1985) that, although the engine was somewhat bulky and noisy, it operated satisfactorily.

Graphite-filament-reinforced carbon or graphite appear promising candidate materials also. The strength of carbon/graphite increases with temperature up to levels which are of meaningful interest for the present application. Such materials also have very low coefficients of thermal expansion. To illustrate the point being made here, one needs only remember that, without such possibility of mechanical and functional decoupling, gas turbines and jet engines would never have become practically feasible. For such engines to become efficient, specific, different and special materials had to be developed and are now used in the construction of each basic component of a gas turbine: compressor blades, turbine blades and combustion chamber walls, for instance. In addition, the present invention provides another type of decoupling: functional decoupling. It should be emphasized that the degree of such decoupling is not fixed, but can be optimized for each operating regime demanded.

To take full advantage of the design flexibility offered by all of the combustion member possibilities, one can vary any or all of the following design parameters:piston stroke-to-diameter ratio, piston peak velocity, peak pressure inside the combustion chamber, piston weight and material. The operating parameters directly affected and to be optimized are: combustion efficiency, surface wear, noise and vibration levels, cold weather starts, cooling and lubrication. This can be done without having to consider the usual constraints imposed on the design of internal combustion engines and which result from construction considerations and/or operational limitations and requirements. To facilitate the ignition of the air-fuel mixture, and sustain it, in cases where low grade fuels are used, the spark plug can be of a high energy type. More powerful and longer lasting sparks can thus be generated. The initiation of the fuel combustion process depends no longer upon the perfectly timed start of an explosion or on fuel self ignition. The cold start problems of gasoline and Diesel engines are eliminated. In addition, because the engine air admission is not throttled, the expansion means can have a volumetric expansion ratio larger than the compression ratio, thereby extracting more energy from the expanding combusted gases. This results in a higher thermodynamic efficiency of the cycle. This is achieved by making expansion chamber 5 larger than compression chamber 3 of engine 1 of FIG. 3.

The higher the compression ratio, the higher the ratio of volumes 5 to 3 can be. This makes the pressure-volume cycle diagram look more like a Brayton cycle (gas turbine) than a Diesel cycle, but with a compression ratio similar to that of an Otto cycle. On a hot day, especially if dry, water or, even better, water-methanol injection in the air admitted at the compressor inlet (or between the first stage compressor outlet and the second stage compressor inlet) can further increase the thermodynamic efficiency appreciably. Water-methanol mixture is corrosive for many metal alloys. Again, the use of ceramics or carbon-graphite composites, made more easier in the present invention, can alleviate such corrosion problems and render the use of water-methanol injection very attractive. The use of such fluid injection can help the engine cooling problems on a hot day, especially for high altitude operation. The use of a heat exchanger between the compressed air and the combusted gas further increases the thermodynamic efficiency of such engine. For all the reasons enumerated and discussed above, the appreciably enhanced thermodynamic efficiency results in a considerable fuel economy, if comparison is made with a gasoline engine of equal compression ratio. As mentioned earlier, cruder and lower grade fuels, and less expensive than gasoline, can be used, possibly of non-fossil origin. The compounding effect of these various factors should result in substantial savings in overall operation cost. Lower noise and vibration levels means more comfort and possibly some weight saving for the vehicle, meaning lower vehicle manufacturing costs. A better and more complete combustion of less volatile fuels can leads to an appreciable reduction in pollutant levels in the exhaust gas. A lower level of combustion temperatures, more like those typical of Diesel engines, means a lower or inexistant nitrogen oxide production. Because of the longer time available for the combustion to take place, for each cycle, the level of solid particulates emitted can be less than for Diesel engines, especially during acceleration periods, for reasons previously mentioned. The need for and the cost of anti-pollution equipment and accessory, and of the costly maintenance thereof, can be considerably reduced, or altogether eliminated. Such additional savings cannot be ignored. The resulting elimination of the need for leaded fuel must also be mentioned here. The ensuing reduction in health hazards to urban populations is also worth noting.

It should be remembered that the above discussed peculiarities and advantages in operation and construction of the model engine apply equally well to the other two basic embodiments of the combustion member. This is not repeated when these other embodiments are specifically discussed later on.

Once started and from the idle speed on up, the operation of of all components and parts remains the same. To describe a typical complete cycle within combustion member 100, the simplest, yet complete assembly depicted in FIGS. 2 and 4 can again be used as model. Using the position 130 shown in FIG. 4 as the cycle starting point, with piston 130 moving in the direction of arrow f, fuel has just been injected and ignited in chamber 102 by spark plug 116. The air admission was also just completed and valves 106 and 120 are both closed. The fuel combustion proceeds as more fuel is being injected by injector 112. The pressure and temperature both rise inside combustion chamber 102, accelerating the piston motion toward the left and thereby displacing the combusted gas in chamber 101. Gas outlet valve 118 is open and the combusted gas there is pushed through exhaust duct 111 into heat exchanger 30 at a pressure level somewhere between the pressure then existing in chamber 102 and the air inlet pressure of the air in duct 113 waiting for air inlet valve 104 to open. When piston 130 approaches position 103 shown in phantom line, valve 118 starts closing. When piston 130 reaches position 103, both valves controlling combustion chamber 101 are then closed. A smaller volume of combusted gas is trapped and acts as a buffer to stop piston 130, and acting as a spring, kicks piston 130 back in the reverse direction. When piston 130 passes back through position 103, gas valve 118 remains closed, but air inlet valve 104 opens and admits compressed air in chamber 101. When enough air has been admitted, depending upon the power level required at this moment from the engine, fuel injection starts by means of injector 110. Valve 104 then closes as required for the power level desired and spark plug 114 is energized. Fuel combustion is then initiated in combustion chamber 101. The process described earlier for combustion chamber 102 is repeated exactly, as a mirror image, if the power level setting has remained the same. Prior to piston 130 having reached position 103 toward the end of its leftward stroke, gas outlet valve 120 had started opening, a short while before gas outlet valve 118 had started closing. Therefore, the flow of high pressure combusted gas into heat exchanger 30 was never interrupted. Also, this action helped relieve the pressure on the right face of piston 130, thereby facilitating its springing back action. The synchronization and timing of the opening and of the closing of these two gas valves is very important.

Piston 130 is now well on its way toward the right, the fuel combustion in combustion chamber 101 is nearly completed, the combusted gas in combustion chamber 102 is being displaced into heat-exchanger/storage-tank 30 via duct 115, the gas pressure in chamber 101 is at its peak. Valves 104, 118 and 106 are closed. Valve 120 is open. Piston 130 rapidly approaches position 105 mentioned earlier. At that time, gas outlet valve 118 starts opening, the combusted gas in combustion chamber 101 begins to exhaust again into duct 111. Soon after, gas outlet valve 120 begin to close, until it is fully closed when piston 130 reaches position 105. Valve 106 is of course still closed. The gas trapped in the small volume on the right of piston 130 then again acts as a buffer and a spring to stop and then launch piston 130 back on its leftward stroke, its rightward stroke being then completed. Valves 104, 120 and 106 are closed. When piston 130 passes thru position 105, now again moving in the direction of arrow f, air inlet valve 106 opens, compressed air is admitted in combustion chamber 102 and the process earlier described for combustion chamber 101 is repeated. Piston 130 reaches the location reached earlier as being the starting position of the typical cycle depicted for the model combustion member of FIG. 4. A full piston motion cycle has just taken place. During this cycle, other events also took place, outside of the combustion member, and which are vital for the proper operation of the piston inside the sleeve. Those events, in chronological order, are described below as the free piston follows the cycle discussed above:

1. Piston 130 location is constantly detected by sensors 134 directly and pressure sensors 142 indirectly. The signals are sent to master control 140 where piston position, direction and velocity are not only calculated for that exact time but also predicted some time in advance and the anticipated value determination is based on past and present information being just processed;

2. The above-generated information is inputed into a real time computer, programmed for comparing the timing of these received signals to the timing required for the combustion member to operate in a prescheduled manner, which includes the valve openings and closings, the initiation of fuel injection and spark plug activation, stopping fuel injection and spark plug activation;

3. The power level requirements are inputed into the computer to adjust the timings of the air inlet valve closings, the fuel injection and spark plug deactivation;

4. The programmed information and the signal information inputed are combined to determine an exact set of all timings to be used during the piston next half cycle (one-way stroke); and 5. Appropriate signals are timely sent to the following parts and components, and in the sequenced order listed below:

(a) air inlet valve 106 control valve 141, to relieve the oil pressure so that valve 106 closes;

(b) a fuel control valve, to start fuel injection through fuel fuel injector 112;

(c) a spark plug high voltage energizing system, for activating spark plug 116;

(d) the fuel control valve, to stop fuel injection and the energizing system for deactivating spark plug 116;

(e) gas outlet valve 120 control valve 141' to apply high oil pressure for opening valve 120;

(f) gas outlet valve 118 control valve 141', to relieve the high oil pressure so as to close valve 118;

(g) if pressure sensor 142 is used, and if malfunction occurs and the proper signal is not received by control valve 141', pressure sensor 142 signal is used to bypass and override the normal system, so that control valve 141' still receives the proper signal (if valve 118 did not close, piston 130 would then make solid contact with the internal wall of combustion chamber 101 or with a slightly protruding part affixed thereon, which would have disastrous results);

(h) air inlet valve 104 control valve 141, to apply high oil pressure for opening valve 104;

(i) step (b) is repeated, but for fuel injector 110;

(j) step (c) is repeated, but for spark plug 114; and (k) step (d) is repeated, but for spark plug 114.

The operational logique and the sequence of events outlined above again apply to the operation of the other two basic embodiments of the combustion member discussed below. Several of the steps and or signals listed above, and the processing thereof, are rendered superfluous when the piston is guided and its location can thus become directly detectable and ascertainable.

The embodiment of the combustion member previously discussed represents an idealized conceptual aspect of a combustion member equipped with a totally free piston. It is used to depict and explain the operation, the advantages and the working principle of an external combustion engine utilizing a free piston combustion system. The disadvantages, shortcomings and limitations of such conceptual embodiment were outlined previously and need no further discussion. They are disposed of in the two combustion member embodiments discussed below by means of the addition of a mechanical guiding system which positions the piston with respect to the sleeve rotationally as a function of its reciprocating motion. This coordination of the two movements (angular and axial), in a fixed and predetermined fashion, facilitates the discrimination between piston axial location and motion direction. The signals emitted by the piston location detecting means thus acquire the singularity of meaning required to remove possible subsequent errors of interpretation. Also, the presence of a mechanical guiding system being connected to both the sleeve end closures and the piston offers the additional possibilities of:

1. Combining the axial and angular motions of the piston inside the sleeve so as to minimize the wear of their contact surfaces;

2. Minimizing the amount of sliding contacts between the piston and the sleeve;

3. Minimizing the danger of the piston making physical contacts with the sleeve end closures and/or any appurtenance thereof;

4. Cooling the piston from the inside out;

5. Lubricating the piston/sleeve interface from inside the piston, between the piston ends;

6. Detecting the piston location and angular position by means of direct mechanical contact;

7. Generating signals representative of such piston location and position directly and unequivocally;

8. Positioning the mechanical piston guiding system at locations and in such manner that its parts can be constantly lubricated;

9. Insuring that each piston location and position detected and the representative signals generated therefrom cannot be affected by time, heat and/or externally applied forces; and 10. Arresting, positioning and restraining the piston at a preset axial location in the sleeve when the engine is not running, so as to simplify and ease the restarting of the engine.

Most of these possibilities are compounded in the combustion member constructions shown in FIGS. 15 through 39. In summary, two different piston guiding systems are presented and two valving approaches are described. Each one of the two piston guiding systems can be combined with either one of the two valving approaches. For the sake of simplification, only three of the four possible combinations are described in the last section. Only one valving system is combined with only one piston guiding system, as represented in FIG. 19. The piston guiding system of FIG. 18 can also be combined with poppet valves, but appears the least desirable because the presence of an appendage attachment to one of the two sleeve end closures renders the accommodation of poppet valves difficult onto the end closure supporting the sleeve appendage. Therefore, its description is omitted and so is its discussion in the following. The poppet valve system is discussed earlier in the case of the firt embodiment of the combustion member. Its operation is similar. The automatic valving system of the combustion members of FIGS. 15 to 18 operates quite differently and needs be discussed in detail.

Automatic Piston/Sleeve Valving System:

The piston and its associated sleeve are equipped with vents and ports which register when the two components occupy established relative positions. These positions are set by the designs and locations given to these vents and ports on and inside the piston, and in the sleeve wall. The registering occurs automatically and repeatedly as the piston performs its elliptically-shaped movements, axial and angular, with respect to the sleeve. In the last section, the manner in which such oscillatory motion is imparted to the piston has already been described in enough detail and is further discussed later in this section.

The phantom line ellipse of FIG. 15 depicts this resulting oscillatory motion of piston 190. FIG. 16 shows all the valving openings on the outer cylindrical surface of the piston and the two cooperating ports in the sleeve. Openings 175 and 177, and ports 179 and 178 (not shown in FIG. 16) are used for compressed air inlet valving. Openings 174 and 176, and ports 180 and 181 (not shown in FIG. 16) provide the oulet valving for the combusted gas. However, the openings 175 and 177 must be connected by ducts 183 and 185 located inside the piston wall. They connect the combustion chamber which is the furthest removed from opening 175 or 177, as the case may require.

This requirement is dictated by the imperious necessity that inlet and outlet valves which control the same combustion chamber must obviously never be open at the same time, and that two inlet valves must never be open at the same time, either; whereas, outlet valves can and should be open at the same time, during part of any cycle, as shown in FIG. 9, where the valving by the piston is illustrated in phantom line for comparison with the valve operation of the first embodiment. Because the registerings of the piston openings and of the sleeve ports never correspond, on the basis of totally time-integrated area, to the equivalent of a full poppet valve opening, which fully opens for some time, the areas open for air or gas passage, which vary continuously as the piston moves, must have a larger maximum value. For the sake of simplicity, however, the full openings of both the poppet valves and the registered piston-openings/sleeveports are shown as being equal. They have been both normalized to correspond to their maximum areas. What is shown in FIG. 9 are the percentages of opening area. One may say that the total amounts of open areas, integrated as a function of time, for each piston cycle should be about the same for either configuration. This means that the maximum open area of an opening/port at its optimum registering position must be much larger than the area of the passage presented by a fully open poppet valve. The piston rings do not pass over the gas outlet ports in the sleeve, however, they must pass over the air inlet ports in the sleeve. The corners of the intersections of the internal surface of sleeve 198 with the internal wall of ports 178 and 179 must be adequately rounded off. Although two air inlet ports in the sleeve are shown in FIG. 15, for ease of understanding, only one is needed in the actual construction, as shown in FIGS. 16–17.

The piston oscillatory movements are imparted by two guiding stub-groove assemblies as earlier described, but these assemblies are located inside piston 190 and the stubs are fixed, and the grooves become integral part of piston 190, when a central shaft is used to guide the piston. If cooperating male/female appendages are used (FIG. 18), the stubs may be affixed to the piston stem extension 121 and the grooves are located in the wall of the sleeve appendage onto its internal surface. In the first instance, the piston motion may be detected simply and directly by an electro-mechanical sensor (FIG. 36). In the second instance, the piston motion may just as easily be detected directly electronically or electro-mechanically by sensors mounted on appendage 122 and sensitive to the passage of the guiding stubs at the end of appendage stem 121. The electro-mechanical sensors are constructed and operate like those shown in FIG. 36, but in which the arrangement of pins 216, bellows 235, electrical contact 238 is modified for mounting at the proper locations in the wall of appendage 122, in a manner such that pins 216 may fulfill the role of bumps 226 on the bottom surface of the cooperating grooves in appendage 122 wall. The electronic sensors are constructed and operate like the sensors 134 shown in FIG. 4, but are located at only a few detecting sites on appendage 122 and sense the passage of a stub end in front of them. Variations in local magnetic fields or sonic impedances are caused by the passages of a stub at such sites and such variations are then detected by the sensor which is constructed to sense magnetic fields or sound waves, as their construction type may require. Appropriately selected types of transducers for such application, as is well known in the art, then emit electrical signals representative of such variations and which are then received and handled by a central processing unit (CPU) for controlling the engine, in a manner discussed later in this section.

Because the compressed air and the combusted gas valving is automatic in this embodiment of the combustion member, detection of the piston location is needed and utilized to time two essential functional steps of the combustion member operation: fuel injection and initiation of the spark plug activation. Because the piston and its guiding stubs (or its grooves and their bumps 226) are fixedly connected and the positions thereof, relative to the sleeve and its ports, are always singularly and unequivocally determined, the timing of the initiation of the fuel injection and of the spark plug activation are also always similarly fixed with respect to the valving operation. Synchronization of all these functional and operational steps is automatic and self regulating. The duration of the valving, expressed in percentage of the piston stroke, is also fixed. However, several other external avenues are left open for further adusting valving, fuel injection and spark plug activation in order to control the engine operation. This aspect of engine operation is described and discussed later in this section.

Poppet Valve Valving System:

This combustion member embodiment is depicted in FIG. 19. A hollow shaft extending from one end closure to the other end affixed thereto is centrally located around the sleeve axis of symmetry. If piston/sleeve interface lubrication is provided as earlier described, swiping rings 146 are used. If piston and sleeve are made of compatible high temperature materials, lubrication and swiping rings may not be needed. In any case, piston 130 is guided by shaft 190 in a manner such that under normal operating conditions, piston 190 does not make contact with the sleeve during its oscillatory motion. Lubricating and/or cooling fluid is however required inside the piston to lubricate and/or cool the piston location detector pins and the stub/groove interfaces. In such instance, sliding sealing rings 146' are used between the hollow shaft external surface and piston 130 lands 96 and 96'. The fit between the piston land inner diameters and the shaft outer diameter is such that adequate clearance between the piston external cylindrical surface and the sleeve internal cylindrical surface is always provided. In such construction case, the external cylindrical surface of the piston exhibits small gas expansion grooves (not shown) extending circularly around the piston so as to limit the compressed air and/or combusted gas leakage between the two combustion chambers and minimize any detrimental jetting effects which could otherwise materialize at times.

The coordinated axial and angular movements of the piston are created in the manner earlier discussed and the stub/groove system that imparts it rotational motion to the piston is not shown in FIG. 19. The piston detecting system was also discussed earlier and it is also omitted in FIG. 19. In comparison with the combustion member shown in FIG. 4 as model, three additional components are introduced in FIG. 19: (1) cable 270 transmitting the signals representative of the piston location, (2) pressure transducers 250 and 250', and (3) the high pressure hydraulic fluid duct (not shown) which channels the fluid to the brake systems 38 and 38' of the piston shown in FIG. 15 and already discussed.

As previously mentioned, a shaft construction is preferred over an appendage system for this combustion member embodiment, although the latter could also be used, but appears less suitable for and/or adaptable to sleeve domes or end closures because of space limitations imposed by the presence of the valves.

These valves operate like the valves of the model embodiment of FIG. 4. They receive high pressure hydraulic fluid from timing valves such as 141 of FIG. 11 working in conjunction with the pressure balancing systems shown in FIGS. 12 and 13 in order to provide the pressure levels indicated in the graphs of FIG. 14. Timing pilot valves 141 are controlled by signals received from the CPU in response to the signals received from the piston location and position as detected by pins 216. Other signals may from time to time be sent to the CPU which either override the piston detection signals or are superimposed thereon as the case may require. This is discussed later in this section. However, it is worth noting that the valve operation may result directly, instantly and singularly from specific signals indicating where the piston is at that time and what side of the elliptically shaped grooves it is travelling on, as compared to such locations and positions being computed for the model embodiment.

The signals for initiating fuel injection and spark plug activation are emitted, transmitted to and received by the CPU for processing thereby as is the case for the automatic valving system embodiment previously discussed. The signals for initiating the opening of both the compressed air inlet valves and the combusted gas outlet valves sent by the CPU and received by the timing pilot valves need not be synchronized with the corresponding signals sent by the piston location and position detectors. Depending upon the operating conditions of the engine and combustion member at a specific time, a time delay may be inserted between the receiving end and the sending end of the CPU (between input ports and output ports) so as to accommodate engine operation control demands such as: (1) delayed opening of the inlet valves, (2) cancellation of a normal signal to open and/or close a specific inlet valve, and (3) cancellation of a normal signal to open and/or close a combusted gas outlet valve. Such special and specific handling of these signals may be needed at times during the engine starting and stopping cycles, and/or during the initial periods of extreme accelerations and/or decelerations from an engine steady-state operating condition. These special requirements are caused by the presence of the heat-exchanger/storage tank between the power delivery system and the combustion member as is mentioned earlier. The duration of the opening of the compressed air inlet valve, in percentage of the piston stroke, is determined by the CPU as function of the engine power level need.

Because the combustion member embodiment of FIG. 19 offers the possibilities of adjusting the openings and the closings of the four valves, as just mentioned, the regulation of the amount of compressed air introduced in each combustion chamber during each piston cycle (two combustion chambers, hence two cycles per piston full travel, or two piston strokes, back and forth) may be performed without the use of externally located valving means (not the case for the automatic piston/-sleeve valving system). The function of the air intake valve of FIGS. 23 and 24 is performed by the operation of the inlet poppet valves being monitored to adjust the time (percentage of the piston stroke) during which the latter remain open. Air mass flow rate may be determined by using the combination of effective orifice area, pressure differential across said orifice and static air conditions upstream of the orifice (pressure and temperature). As discussed later, all these parameters are either known or detected elsewhere, except for the pressure drop across a wide open inlet valve. Pressure transducers 250 and 250' connected to both the air admission duct and the inside of the combustion chamber on each side of the combustion member measure this vital parameter. They may also be used to indicate the values of the pressure existing inside the combustion chambers as a function of time on an on-going basis. Signals representative of the values of such pressure drop and absolute pressure are sent to the CPU for processing as is discussed below in more details.

Engine Control Systems:

The control systems described and discussed hereinunder perform several functions and have common points. The functions are: (1) engine control under quasi steady-state operating conditions, (2) engine control during periods of extreme transient operating conditions (large vehicle accelerations and decelerations), (3) engine starting, and (4) engine stopping. The role and aims of the control system are to: (1) limit the peak temperatures in the combustion chamber in order to minimize the formation of various forms of nitrous oxides ($NO_x$) which are very objectionable pollutants, (2) maximize the combustion efficiency by making available the maximum amount of time for the completion of the fuel combustion, thereby also minimizing the emission of polluting particulates, and (3) keep the combustion member operating, under steady-state conditions, at regimes such that fuel consumption and production of pollutants are both continuously being optimized.

The two basic engine control systems considered here, one for each valving system, have the following in common: (1) the determination of the amount of air introduced in the combustion chambers, during each piston cycle, (2) the computation of the amount of fuel to be injected in the combustion chambers, during each piston cycle, to maintain the correct fuel/air ratio, and (3) the manner in which fuel/air ratios are adjusted to remain within limits established as a function of the power level demand. Each one of these common features applicable to both control systems is discussed first below.

Air Flow Determination:

In the most general case, the air flow between the storage tank and the combustion member is not steady, but of a pulsating nature. This is due to the fact that during a piston back-and-forth travel (two cycles or two strokes), inlet valves are either both closed, seldom both open, often partly open simultaneously or often one is open and the other is closed. The pulsation of the compressed air flow is more pronounced if poppet valves are used. If power demand variations are slow, the fluctuating air flow rates through a metering orifice may be averaged over a few cycles of the free piston, process referred to herein as macrotemporal air flow measurement. This is what happens inside a carburetor of a gasoline engine. However, if the power demand variation is very abrupt, the amount of air needed in each combustion chamber also varies very abruptly during one piston cycle. For a short period of time, averaging air flow rates may not provide a fast enough response compared to the instant acceleration or deceleration rates that some present-day gasoline engines yield. A consideration of interest also is the influence that the combustion member regime (piston cycling frequency) may have on an air flow rate averaging process. Because the amount of fuel injected must be directly function of the air amount introduced in a combustion chamber, the macrotemporal air flow measurement is not a preferred construction of the control system, but worth noting.

However, the determination of the amount of compressed air entering an individual combustion chamber, during each cycle, seems to have the potential of a more accurate measurement process. During a very short period of time (small fraction of a piston cycle), the air flow rate through an orifice may be calculated if the characteristics of the orifice and of the air flow through that orifice are known. Instantaneous computation of the amounts of air passing through such orifices during very brief instants is possible. This air amount determination is referred to herein as microtemporal air flow measurement. Referring to FIGS. 20 and 21 in which X-detection indicates the cycle fraction during which the piston travel is continuously detected by means of a bump in a groove bottom, soon after such X-detection is initiated, at which time the piston has reached a return velocity of some significance, the corresponding compressed air inlet valve opens. A very brief instant hence, when the valve is known to be wide open from experimental results, the air flow through that valve is then deemed to be well representative of the total amount of air that will pass through that valve during the remnant of that cycle. The specific correlation factor between these two values is also established experimentally. This total amount of air may thus be predicted, by means of computations carried out by the CPU, by the time the X-detection is completed, at which time the piston mean velocity over the length of the X-detection bump may also be computed.

The instantaneous air flow rate $\dot{W}_a$ in lbs/sec through an orifice of area A ($in^2$) with an air pressure P (psi) at the station of area A in a duct where the air velocities upstream and downstream are much smaller than the air velocity through area A, which is assumed to remain always subsonic, is approximately: (a) $\dot{W}_a=2.05\text{-}C\cdot A\cdot P[(1/T)\cdot(1+Y)\cdot Y]^{\frac{1}{2}}$ where $Y=(P_u/P)^{0.283}-1$. T is the absolute temperature of the air and $P_u$ is the air pressure upstream of the orifice where the air velocity is low. This is based on a value of 1.3937 for the air polytropic coefficient for a discharge coefficient C of the orifice of area A. As earlier shown (FIGS. 23 and 32), the geometries of both the air intake valve and the air inlet valves, when fully open, are such that the value of C varies very little and can be assumed to remain constant, once it has been experimentally determined. As is mentioned earlier, both compressed air pressure and temperature are measured in the storage tank. The pressure drop losses between the storage tank and the intake valve, or the inlet valves, can be either ignored as negligible or taken into account as a small fraction of $P_u$, as determined experimentally for a given air ducting construction and made function of $\dot{W}_a$ in an iterative fashion within the program routine loop used to compute $\dot{W}_a$ from equation (a). Such an approximation may be written as: (b) $\Delta P_u=K\cdot F(\dot{W}_a)$ where: K is a proportionality constant determined experimentally, $\Delta P_u$ is the pressure loss and $F(\dot{W}_a)$ may be approximately expressed as $(\dot{W}_a)^2$, a turbulent air flow being assumed in the duct. In equation (a), in the computation process of $\dot{W}_a$, the roughly exact value of $P'_u$ of $P_u$ may be written as:

$$P'_u=P_u-K\cdot(\dot{W}_a)^2. \qquad \text{(c)}$$

Because $\dot{W}_a$ is now to be calculated using equation (a) and (c) jointly, $\dot{W}_a$ is really expressed as a function of itself. Although resolving such equation algebraically is a very arduous task, its present-day resolution by means of an IC computer requires only a fraction of a millisecond, if a result accuracy of one tenth of one percent is desired, which is hardly the case here. The iteration process of the computer calculation stops when the $(n+1)_{th}$ result obtained differs from the $n_{th}$ result by less than $10^{-3}\dot{W}_a$ if one tenth of one percent accuracy is wanted, n being the penultimate iteration performed in this particular computation. The handling of the iterative solving of complex equations with computer programs is state-of-the-art and needs no further elaboration here. Air pressure could be measured in chamber 286 of the intake valve (FIG. 23), in chamber 286' (FIG. 19) or in manifold 152 (FIG. 17), as the case may be. In such instances, $\dot{W}_a$ could be calculated directly, but the pressure measurements may be much less accurate. Accurate pressure measurements in the storage tank are easier to make repetitively and are preferred.

If a macrotemporal air flow measurement approach is used, either singularly or in conjunction with the microtemporal method, as is possible and discussed later, especially in the case of the automatic valving embodiment, the same measurements and computations are used and conducted. However, the pressure measurement results become a function of time and are integrated as a function of time over that time period during which the measurement was made, then averaged by dividing the integrated result by such time period. Of course $\dot{W}_a$ is a rate of air weight flow, and the total amount of air, in meaningful weight units, introduced, or in the microtemporal case to be introduced, in the combustion chamber is the parameter of interest. This amount of compressed air, for each piston cycle is:

| | | |
|---|---|---|
| for the microtemporal | $W_a = \dot{W}_a.F_{(X,t)}.\Delta t$ | (poppet valves) |
| method: | $W_a = \dot{W}_a.F_{(X,\dot{X})}$ | (automatic valving) |
| for the macrotemporal method: | $W_a = \dot{W}_a.\Delta T/n_c$ | (both valving modes) |

The three equations above, called (d), (e) and (f) respectively, are used to calculate $\dot{W}_a$ as a function of $W_a$ as the case requires (combination of valving mode and temporal method). In the equations above, the newly introduced factors are defined below:

$\Delta t$ is the time during which the inlet valve is open (variable);

$\Delta T$ is the time duration of $n_c$ piston cycles (set);

$n_c$ is the number of piston cycles during which the pressure $P'_u$ is averaged for use in the computation of $\dot{W}_a$ to be utilized for the next piston cycle series of computations;

$F_{(X,t)}$ is function of the piston travel X during the time $\Delta t$ during which the air inlet valve remains open, and of that time also; and $F_{(X,\dot{X})}$ is function of the piston travel X (fixed) during which the air inlet valve remains open, and of the piston velocity $\dot{X}$ as calculated at the end of the X-detection bump.

$\Delta t$ is used to adjust the engine power delivery by varying the time during which the air inlet valves are allowed to stay open. $\Delta T$ is determined when $n_c$ is set. This number may be fixed or adjustable according to the engine control system construction. $F_{(X,t)}$ and $F_{(X,\dot{X})}$ must now be discussed and are only applicable to the microtemporal method of computation of the amount of compressed air introduced in a combustion chamber during the corresponding piston stroke, for which no absolute time scale exists.

It is assumed in all of the following that when some characteristics of both a combustion member in combination with a storage tank have been experimentally established for a given construction, these will essentially not vary with time or between different units of the same design and construction. Under those assumptions, a universal relationship may be established between known values of $\dot{W}_a$, the known values of the volume displaced by the piston and either the known time during which such displacement takes place (poppet valve case) or the calculated time during which such displacement occurs (automatic valving case). It musst be remembered that time, in matters pertaining to the free piston, can only be expressed as a percentage of the piston cycle or stroke, since the piston travels at variable axial velocities and is not mechanically coupled to an accessible part. It is also essential to remember that the free piston, under steady-state operating conditions, repeats the same motion schedule during each and every cycle. The number of cycles can also serve as unit of time. Each one of the "F" functions in equations (d) and (e) is discussed separately below and applies only to steady-state.

In the poppet valve combustion member embodiment of FIGS. 19 and 21, when the piston reaches the end of the X-detection bump, the inlet valve is fully open, and the piston has acquired a velocity $\dot{X}'$ of no direct interest in this case. It is assumed that the compressed air pressure upstream of the inlet valve is higher than the pressure exerted by the combusted gas on the other side of the piston. Under such circumstances, the amount of air pushed into and sucked in the combustion by the piston motion is function of the volume displaced by the piston travel until the inlet valve closes. At which time no more air can be pushed into nor be sucked in that combustion chamber. The amount of piston travel during that time directly affects the amount of air admitted. However, the real time (or absolute time) during which the inlet valve was open affects the effectiveness with which the compressed air was able to enter the combustion chamber (influence of the air velocity through the valve opening), the relative importance of the duration of the opening and closing phases of the inlet valve, and the relative importance of the time overlap between the X-detection period and the full opening of the inlet valve. The real time $\delta t$ taken by the piston to travel the length of the X-detection bump is measured by a time-base clock in the CPU which, in combination with the fixed length of said bump, yields the average piston velocity $\dot{X}=l/\delta t$ reached at the end 3 of said bump, where l is the length of the bump. Piston velocity $\dot{X}$ varies only slightly from cycle to cycle during steady-state operating conditions, but varies appreciably according to the engine power delivery demand or during transient conditions. Assuming that the inlet valves may remain fully open during an adjustable portion (m to M) of the piston stroke, m corresponding to idle and M to maximum power settings, the percentage of power delivered between idle and maximum is set to be roughly proportional to the length ratio of segments m-4 to m-M, assuming that point 4 corresponds to an intermediate power demand setting. A correction coefficient $K_a$ is determined experimentally as function of the length ratio of segments (m-4)/(m-M), which is indirectly dependent on $\Delta t$. A second correction coefficient $K'_a$ is determined experimentally and corresponds to $\dot{X}$.[(m-4)/(m-M)] which is function of the travel $\dot{X}$ covered by the free piston during the time $\Delta t$ that the inlet valve is open.

$\Delta t$ is not known in real time units. It is related to (m-4)/(m-M) and to $\dot{X}$ and may be expressed as K'.X.[(m-4)/(m-M) and in which K' may be determined experimentally. Because [(m-4)/(m-M)] represents an intermediate power setting (percentage p expressed as a fraction of the maximum power setting) and is always known, being inputed as demanded percentage of the maximum power, equation (d) can be rewritten as $\dot{W}_a=W_a \cdot K_a \cdot K'_a \cdot K' \cdot p$ where p corresponds to $\rho$ (power delivery demand) and is inputed as percentage of the travel of the power demand lever handled by the operator of the engine. As earlier mentioned, the three correction coefficients $K_a$, $K'_a$ and K' are not constants but depend on the operation regime of the combustion member and the power demand level. They are established from experimental data for combinations of power levels and free piston cycling frequencies, for each engine and combustion member designs, constructions and modes of coupling. The amount of air introduced in each combustion chamber monitored by poppet valves is now determinable in response to detected input parameters and calculable values of coefficients.

In the automatic valving combustion member embodiment of FIGS. 15–17, 20 and 23, the opening and closing of the air admission valves are fixed and an externally located air intake valve performs the "throttling" function of the inlet poppet valves just discussed. However, the flow rate of the air entering a combustion chamber varies continuously during their open time, because the degree of air flow throttling resulting from the varying degree of port and vent registering is not constant. Yet, this varying always repeats from cycle to cycle. It is only function of the rate at which such throttling action varies and of its duration. The duration is directly related to the piston velocity and the rate of its variation is indirectly related to that duration. Thus $F_{(X,\dot{X})}$ can be rewritten as $K_{a'}.K_{a''}.\dot{X}$ where $\dot{X}$ is the average velocity of the piston ($l/\delta t$ as previously expressed), $K_{a'}$ and $K_{a''}$ are variable coefficients determined experimentally for various combined values of power levels (adjustments of area A of the air intake valve or x, or p as previously discussed) and cycling frequencies of the free piston. Equation (e) may thus be rewritten as $W_a=\dot{X} \cdot K_{a'} \cdot K_{a''} \cdot \dot{W}_a$. For a specific engine/-combustion-member/storage-tank coupling, combustion member design and construction, and regime thereof, the amount of air admitted in either combustion chamber is determinable in response to measured parameters or calculable variable coefficients representing both the piston motion and the power demand level.

The macrotemporal method applies to both valving modes and ignores the variations of piston velocity during the piston cycles, which is obviously acceptable if the engine power delivery needs vary only slowly, such as would be the case of the engine of an automobile cruising steadily along a freeway. In such instance, it is simpler, more avantageous and possibly more exact to use equation (f) which applies to both valving systems. In this approach, the number $n_c$ of piston cycles is the number of times the X-detection bumps activate a piston location sensor. The average velocity $\dot{X}$ of the piston during this activation period $\delta t$ is calculated as $1/\delta t$, and is used to compute other timing parameters used for fuel injection and spark plug timing. The time $\Delta T$ taken by the piston to travel through $n_c$ cycles is measured by a real time clock in the CPU and $W_a$ of equation (f) can be computed for the next cycle. The process is repeated after each cycle or after a specific and possibly adjustable number of cycles, depending upon the rate at which the power demand level is varying at that time. A proportionality coefficient $K_n$ may be introduced in equation (f), also determined experimentally for each valving system, combustion design and construction, engine/combustion-member coupling arrangement with the storage tank, and for various combinations of operating regimes thereof. The combined use of both microtemporal and macrotemporal approaches to conrolling valving is of most interest, though. Both systems require the same basic input signals, only the processing modes of the signals, namely pressure, by the CPU differ, although they are compatible.

Such a combined use means that the macrotemporal system operates constantly, but that its output signals, representative of the amount of air admitted per cycle, as computed by means of the pressure averaging process, are overridden by the corresponding signals representative of another computed value of the amount of air, as computed by the microtemporal system and which uses pressure values measured during a very short instant, whenever the rate of change of power demand exceeds a set value, in either direction: increase or decrease in power level. Such approach satisfies the requirements of both highway and city driving. In a further refinement, the CPU computer can be programmed in a manner such that: (1) one system takes over when the other fails, and (2) the more accurate macrotemporal system may be used to check and "recalibrate" the microtemporal system (readjusting some values of the variable coefficients previously discussed).

To that effect, after a determined odd number of piston cycles, during periods when the macrotemporal system is in use, the microtemporal system is switched on automatically and is caused to operate in parallel with the macrotemporal system. The amounts of air $W_a$ computed by both systems are then compared. During normal steady operation, the differences between such two results must not exceed a set percentage number ($\epsilon^*\%$) if $\epsilon=(\dot{W}_a-W_a/\dot{W}_a$ where $W_a$ is the result yielded by the macrotemporal system and $\dot{W}_a$ is the result yielded by the microtemporal system. If $\epsilon$ is either smaller or larger than $\epsilon^*$, a warning signal is given to the engine operator. The operator then may have both systems checked at the first opportunity or, if the engine seems to run normally at various steady operating conditions, he/she may decide to cause the microtemporal system to self-adjust. In the latter instance, a computer sub-routine loop determines from the results obtained by the macrotemporal system the corrections to make to the coefficients $K_a$, $K'_a$ and/or $K'$ in order to bring the value of $\epsilon$ below $\epsilon^*$, for set operating conditions of the engine (i.e. set vehicle speeds for specific gearbox settings, in the case of an automobile). Such self-adjustments may be temporary until adequate facilities are encountered by the operator or final depending upon the degree of refinement and/or reliability of the macrotemporal system as compared to that of the microtemporal system.

Whenever the microtemporal system is in use, the possibility exists that if the air intake valve or an air inlet valve is permitted to close very suddenly, in case p is caused to vary from a maximum to a minimum value, the combusted gas pressure on a side of the piston exceeds the compressed air pressure on the other piston side. Such condition may cause the piston to stop at midstroke and "stall" the combustion member operation. The end results of such occurence are comparable to those of the stalling of an internal combustion engine and are to be avoided. The probability of such a condition developing may be alleviated by insuring that neither of these valves is allowed to vary its rate of closing faster than a set number $n'_c$ of piston cycles when p is caused to vary a given fraction of its maximum-minimum range.

During a rapid engine power decrease, another possibility is available with the external combustion engine, that of causing a bypass of some of the combusted gas directly into the atmosphere instead of in the expansion side of the engine. Such a possibility will insure that, because the outlet valve of the combustion chamber opposite to that in which the compressed air is being then introduced is always open, the gas pressure in that combustion chamber will fall off very rapidly, thereby minimizing the risk of "stalling" the free piston. Bypass valve 280 of FIG. 23 is installed between the combustion member and check valve 290 on storage tank 30 for such a role. This action enables $n_c$ to be decreased safely to a value of 2 to 3.

Fuel Injection Determination, Ignition and Timings:

As earlier discussed and as is customary with Diesel engines, the control of air pollution is facilitated when the combustion temperatures in the combustion chamber are kept as low as possible, during all phases of the engine operation. Also, eliminating the disadvantage of the Diesel engine of excess unburned combustibles being present in the exhaust gases during periods of high accelerations is of great interest. The most direct way to insure that the fuel/air ratio always remain within set limits, established to obtain the lowest possible combustion temperatures and a certain excess of air in all instances, is to meter the amount of fuel injected as a direct function of the amount of air available for burning it within preset boundaries of fuel/air ratios.

In all embodiments of the combustion member herein, the quantity of air by weight is calculated for each admission and each combustion chamber. In order to limit the combustion temperature during accelerations and also insure satisfactory combustion during decelerations, the fuel/air ratio $W_f/W_a$ of FIG. 38 must remain below the MAX. and above the MIN. values of the graph. During an acceleration from point a to point d for instance, the fuel/air ratio follows curve a-b-c-d. During a deceleration from point e to point h for instance, the fuel/air ratio follows curve e-f-g-h. During steady-state operation, $W_f/W_a$ is adjusted to vary as a function of p (Power Level) along the straight line passing through points a, h, d and e, starting at a level slightly higher than the MIN. value and ending at a level slightly lower than the MAX. value.

For each value of p between I (idling) and $\rho_{max.}$, the amount of air weight admitted in either combustion chamber under steady-state operating conditions, is determined by $r_{f/a}$ (or $[W_f]/[W_a]$) which is the number that determines the amount of fuel to be injected in each combustion chamber as a function of $W_a$ computed by either equation (d), (e) or (f) as the case requires. The variation of $r_{f/a}$ as a function of p can be expressed by the equation (i) $r_{f/a}=r_o+k\cdot p$, where k represents the slope of the straight line of FIG. 38 graph. Once p is selected by the operator, the value $r_{[f/a]}$ is set for use by the CPU to compute the amount of fuel weight to be injected for each value $W_a$ already calculated. Equation (j) is then used: (j) $W_f=r_{[f/a]}\cdot W_a$, and $W_f$ for that cycle is then defined.

The amount of compressed air admitted per cycle varies considerably between full power at sea level and idling at high altitude. The corresponding amounts of fuel injected per cycle vary even more. It may be assumed that the fuel is injected through a fixed orifice representing the injector. Under such circumstance, the fuel flow rate may be adjusted by varying the pressure pushing the fuel through the injector and the fuel amount may be further metered by adjusting the time during which the fuel is allowed to flow in at that rate. To insure a good combustion, the fuel must be finely divided into droplets of the smallest size possible. For any injector orifice design, this is achieved when the injection pressure ($P_i$) is also as high as possible. However, the flow rates of a liquid through a fixed orifice vary as the square root of the pressure. To obtain a variation of 10/1 in flow rate, the pressure would have to vary by a factor of 100/1. Because the minimum fuel amount requires at least a minimum injection pressure of say 100 psi and may represent only 1/30 of the maximum fuel amount per cycle, the maximum pressure would be $100\times(30)^2$ or 90,000 psi which is absurd. However, if the fuel injection duration can be varied by a factor of say 10/1, the pressure needs vary then only by $(3)^2$ or 9/1, which means that the pressure may have to vary between 100 and 1,000 psi, a much more reasonable range. For the purpose of this disclosure, it is assumed hereinafter that the pressure levels may vary by a factor of 10/1 and that the fuel injection duration may also vary by the same factor. The manner by which the fuel is injected needs no further elaboration, being well known in the art. Suffices it to mention that the CPU, upon computation of $W_f$ determines both the duration $\Delta t_f$ of the injection and the injection pressure. Representative signals are sent to a present state-of-the-art fuel-injection/control-system. The determination of the optimum balance between fuel pressure and injection time adjustments is made experimentally and the results are used to establish an equation relating $\Delta t_f$ and $P_i$ to $W_f$.

The fuel injection $P_i$ is actually equal to the sum of the pressure drop through the injector and the air pressure in the combustion chamber $P_u$. The fuel flow rate varies as the square root of this pressure drop and as the effective injector orifice size $C_i$, therefore, the amount of fuel injected per cycle is:

$$W_f=C_i(P_i-P_u)^{\frac{1}{2}}\cdot\Delta t_f=(r_o+k\cdot p)\cdot W_a, \quad \text{(h)}$$

from which one gets: (m) $(P_i-P_u)^{\frac{1}{2}}\cdot\Delta t_f=(r_o+k\cdot p)\cdot W_a/C_i$. In equation (m), two quantities are unknown: $P_i$ and $\Delta t_f$. All the other quantities are known, being fixed, computed and/or measured. Another equation is needed. It was established from the considerations previously discussed that both $P_i$ and $\Delta t_f$ can be assumed to vary in the same ratio together, i.e. when one doubles, so does the other. This assumption may seen arbitrary, but is very realistic and practical. Minimum and maximum values of $\Delta t_f$ and of $P_i$ are established from combustion member design and fuel system characteristics considerations. From those and with the assumption just made, one can write the needed additional equation as:

$$P_i=K^*\cdot\Delta t_f+P_u \quad \text{(n)}$$

where:

$K^*$ is a constant coefficient, with dimensions, determined from design, analytical and experimental results; and $P_u$ is arbitrarily the sea level atmospheric pressure multiplied by the engine compression ratio.

Equations (m) and (n) form a system of two equations with two unknowns which may easily be solved by a subroutine of the CPU computer program, as is well known in the art of programming, for each cycle and as soon as the value $W_a$ has been computed.

Output signals representative of the values just calculated of $P_i$ and $\Delta t_f$ are then sent to the control system components which time the fuel injection and adjust the injector fuel delivery pressure. In the case of the microtemporal approach, this is done for each cycle. In the case of the macrotemporal approach, this needs not be done for each cycle, but every so many cycles, depending on the value $n_c$ used by the CPU.

Fuel Injection and Ignition Initiation (or Timing):

The amount of fuel to be injected and the duration of such injection were determined above. This fuel must now be ignited so that its resulting combustion is as effective and complete as possible, and generates the lowest local temperatures possible. The design of the air inlet valve of FIGS. 32–34 and the curvature given to the end of air duct 183 (in phantom lines in FIG. 16) illustrate how the need for air turbulence inside the combustion chambers is met by causing the compressed air coming out of the inlet valve opening to impart a swirling movement to the mass of air and fuel mixture around the guiding shaft. As shown in FIG. 34, typically the fuel spray is caught in and by this swirling motion and passes by the inlet valve, which causes turbulence in the mixture. Soon after, the mixture encounters spark plug 116, either of ordinary type or of the high energy type and of lasting activation, depending upon the type of fuel used. A single spark initiates the combustion (ordinary type) or continuous sparking initiates and helps sustain the combustion during the whole period of fuel injection (high energy with lasting activation). The point common to both types is the time at which the spark is initiated (ignition initiation). It is assumed that the temperature of the compressed air admitted in the combustion chambers is never high enough in an external combustion engine to self ignite the fuel, as is the case in a Diesel engine. Only the timing of that first spark is discussed in detail because the duration of the spark plug activation is too specific. In the latter case, suffices it to say that such duration is related to the duration of the fuel injection, either shorter or even longer, depending upon the type and characteristics of the fuel to be burned. In either event, ignition initiation is temporally related to the initiation of the fuel injection.

Fuel injection is initiated shortly after the inlet valve is wide open and plenty of fresh air is then becoming available in the combustion chamber (points F of FIGS. 20 and 21). The inlet valve starts opening at the time, or immediately after, the X-detection bump has been contacted by the piston location sensor. The ignition is initiated at point I. Points F may be fixed and can be detected by means of another short bump and sensor (case of engine operating with only one type of fuel) or be adjustable by timing (case of multi-type fuel use). Another distinction can be made between the automatic valving and the poppet valve embodiments. In the former case, compressed air is admitted during a constant fixed portion of the cycle. In the latter case, the duration of the air admission may vary considerably between cycles. It should be mentioned again at this time, and remembered, that the inlet valve may remain open during the major part of the combustion, in some constructions of the combustion member of the external combustion engine of the present invention, if and when fuel is introduced slowly and burns slowly also.

In all instances and at no time may the pressure of the burning mixture during the fuel combustion ever exceed the pressure in the admission manifold of the inlet valve when the valve is open, for obvious reasons. After the inlet valve closes and while the combustion process is becoming completed, the pressure of the partly combusted gas may then safely exceed the compressed air pressure. Obviously, the relative timings of the air inlet valving, the fuel injection and the ignition depend greatly upon the nature of the fuel and how it is best burned. However, in all instances, whatever the pressure history is in the combustion chamber during the cycle being discussed, direct work is never extracted from any such excess pressure, only indirectly by pushing "harder" against the combusted gas in the other combustion chamber. Such excess energy is momentarily stored for later extraction in the expansion member by the vane rotor. At this point, it should suffice to note that the poppet valve embodiment offers the greatest flexibility of operation with various fuels, because of its adjustable inlet valve opening. It can be made to operate in a manner more akin to that of a gasoline engine (Otto cycle) using lighter and more volatile fuels. The automatic valving embodiment is less complex (no valve) but seems less adaptable to handling various fuel types. Its operation resembles more that of a Diesel engine and, in combination with a vane engine, even that of a gas turbine (Brayton cycle).

It is assumed hereinafter, for the purpose of further discussion of the control system that:

1. In the case of the automatic valving embodiment, the initiation of the fuel injection is fixed and caused by a bump detected at point F, and the initiation of the ignition is caused by a signal from the CPU variably delayed from the time of the fuel injection initiation, such variation being function of the type of fuel used and of the type of spark plug; and 2. In the case of the poppet valve embodiment, the initiation of the fuel injection is variably timed by the CPU and the initiation of the ignition is also variably timed by the CPU from the time the signal is sent to the inlet valve to open, such variations being function of the type of fuel used, of the spark plug type and of the inlet valve opening duration (power level p).

These time delays are identified below for easy reference and are utilized in the flow charts and diagrams used for describing the operation of the control system. The origin of each cycle is the point where the piston reaches its extreme left or right position and changes the direction of its axial movement. Any and all cycles, by definition lasts $\tau_c$, the time it takes the piston to travel from one extreme axial location to the other (one stroke). All timings and time delays identified below are expressed as a percentage or fraction of $\tau_c$ and correspond to a length of elliptical arcs on which timing points are indicated.

Firstly, the automatic valving system (FIG. 20) timings:

$\delta t_v$—delay in opening the inlet ports (fixed); :0:

$\delta t_b$—time when the X-detection bump originates its first signal (point 2); :0: (fixed)

$\delta t_f$—delay in starting the fuel injection (fixed, point F); :0:

$\delta t$—duration of the X-detection or length l of the bump, used for computing $\dot{X}$ of the piston, (fixed, arc 2–3); :2:

$\delta t_{b'}$—time when the end of the X-detection bump is reached and equal to $\delta t_b+\delta t$, (fixed, point 3); :0:

$\delta t_i$—delay in initiating ignition after the start of fuel injection (point I); :$\delta t_f$: (adjustable)

$\Delta t_f$—duration of fuel injection (adjustable);

$\Delta t_v$—duration of the opening of the inlet ports (fixed); and $\Delta t_o$—timing of the opening of the outlet ports (fixed). :0:

Secondly, the poppet valve system (FIG. 21) timings:

$\delta t^*_v$—delay in opening the inlet valve (adjustable); :0:

$\delta t_b$—time when the piston $\dot{X}$-detection started by the bump (fixed, point 2); :0: (fixed)

$\delta t$—duration of the bump (length l of arc 2–3), used to get X; :2:

$\delta t'_b$—time when the piston X-detection stops (end of bump), (fixed, point 3), equals $\delta t_b+\delta t$, used to compute $\dot{X}$; :0:

$\delta t_f$—delay in starting the fuel injection (fixed, point F); :0:

$\Delta t_m$—minimum timing of inlet valve closings (fixed, point m); :3:

$\delta t_i$—delay in initiating the ignition after the fuel injection start (point I, adjustable); :$\delta t_f$:

$\Delta t_f$—duration of the fuel injection (point 5, adjustable);

$\Delta t^*_v$—duration of the inlet valve opening (point 4, adjustable);

$\Delta t_M$—maximum timing of inlet valve closings (fixed, point M); :3:

$\Delta t_e$—bump timing for outlet valve activation (fixed, point 6); :2:

$\Delta t^*_o$—timing of the opening of the outlet valve (point 6'), from (fixed) point 6 timing, of the subject combustion chamber; and :6:

$t'^*_o$—timing of the closing of the outlet valve (point 6''), from (fixed) point 6 timing, of the opposite combustion chamber. :6:

In the list of timing definitions above, a few items of interest should be mentioned. They are presented below:

1. During the twin cycles (upper branches of the ellipses), the same timing approach is repeated (FIGS. 20 and 21);

2. For the automatic valve system, the opening and closing of the outlet ports are fixed, and point 6 corresponds to a bump signal used to check that the piston average velocity $\dot{X}$ obtained from the signals generated by bump 2–3 and not needed to monitor the opening and/or closing of the outlet ports, points 6' and 6'' being thus fixed, is close enough to reality;

3. X is obtained, as earlier mentioned, by dividing l by $\delta t$;

4. The notation ": :" with information in-between each ":" is used, when applicable, to indicate the time origin of that time delay, :0: means that the delay starts from point 1 or origin of the cycle, :2: or :3: or :6: means that this delay starts from the time a signal was generated at points 2, 3 or 6, :$t_f$: means that the ignition starts $\delta t_i$ after the fuel injection has started, all such times being expressed as fractions of $\tau_c$.

An adjustment to the computation of $\dot{X}$ is needed whenever the steady-state operation conditions change enough to render predictions of future events in a cycle too incorrect, as compared to values more in line with reality. In the case of the automatic valving system, point 6 bump and its corresponding signal are not needed, except for the use now being discussed. Dividing the travel $X_{2-6}$ by $\Delta t_e$ (starting at point 2) yields an average piston velocity $\dot{X}_{(2-6)}$ which is certainly much more representative of the true piston average velocity during most of its stroke than $\dot{X}$ is. When variations in the values of p exceed a specified percentage, every few odd number of cycles, $\dot{X}_{(2-6)}$ is computed and compared to $\dot{X}$. Whenever the difference between the two values exceeds a specified percentage, $\dot{X}$ is corrected by means of an adjustable coefficient $K_x$ in the equation $\dot{X}=l/\delta t$ which then becomes $\dot{X}=K_x \cdot l/\delta t$, in which $K_x$ can be either greater or smaller than unity. The correction process is repeated until the difference $\dot{X}-\dot{X}_{(2-6)}$ becomes less than the specified percentage mentioned above. A similar correction approach may be used by means of utilizing point 7 (equivalent of point 1) instead of point 6; however, it is believed that eliminating the travel portions corresponding to ellliptical arcs 1–2 and 6–7 will yield more exact information better representative of the piston average velocity during the most important portion of its stroke. Furthermore, in the case of the poppet valve system, the timing delays in the opening and closing of the outlet valves (points 6' and 6'') originate from point 6 and should correspond to the truest value which is obtainable. The timely closing (point 6'') of the combusted gas outlet valve of the combustion chamber opposite to that which is being monitored is very critical, for the amount of combusted gases trapped in it determines the rebouncing of the piston from position 7 (or 1 in the next cycle). It might even be necessary in the case of this poppet valve system to provide another elongated timing bump such as 2–3 which would enable the computation of a third average piston velocity during a period of time and at a time much closer to point 6'', such as point 8. The overlap (arc 6'–6'') of the open positions of both outlet valves is desirable so as to prevent pulsating in the delivery rate of combusted gas from being generated. Such overlap should also be kept as small as possible so as to minimize the risk of excess interference between the two combusted gas flows, the pressure in one combustion chamber being lower than the pressure in the combustion chamber in which combustion was just completed.

Operations of the Control Systems of both Valving Embodiments:

Both control systems (one for the automatic valving embodiment and the other for the poppet valve embodiment) share common features and types of engine accessories. Those items are discussed first before the detail aspects specific to a valving system are separately discussed. The operation of both control systems is described in the form of flow charts, summary schematic diagrams and block diagrams. The most salient features of the schematic diagrams and of the block diagrams are then discussed.

The features and accessories common to both control systems are as follows:

1. A Central Processing Unit (CPU) including Input Ports for receiving signals, Output Ports for sending command signals to the various engine accessories and components, a memory storage and a computer for computing the values of the output signals according to a series of equations which relate input signals and pertinent stored input data to output signal values;
2. A fuel pump driven by the engine accessory shaft and capable of delivering the maximum fuel flow rate envisaged at the maximum pressure ever to be required;
3. A fuel pressure regulator monitored by the CPU for adjusting the fuel pressure to values dictated by the output signals;
4. Fuel injectors considered having a fixed discharge orifice;
5. Spark plugs of a type most suitable to the nature of the fuel to be burned;
6. High voltage generator for activating the spark plugs; and
7. Input ports for receiving the input values of the power settings demanded by the operator, input data reflecting the characteristics of the fuel to be used, said characteristics including the fuel density, the specific heat of combustion and an ignition factor constant representing the burning ability of the fuel.

One general summarizing flow chart for the most complex valving system (poppet valves) and microtemporal method is presented below, only the simplifications possible with the use of the automatic valving system and for the macrotemporal method are then discussed in the two other cases of interest here. The equations are listed in the order they are solved by the CPU computer and the column on the right indicates where and how the values of the various coefficients are obtained. If simultaneous solving of two or more equations requires the use of an iterative approach, it so indicated.

GENERAL FLOW CHART (POPPET VALVE SYSTEM EMBODIMENT)

| Step # Equations & Solving Sequence | Coefficients and Results |
|---|---|
| I Air-Amount/Cycle Calculation. Solve: | $\tau$ and $P_u$ |
| 01 $Y = (P_u'/P)^{0.283} - 1$ | P-detected (input signal) |
| 02 $\dot{W}_a = 2.05CA_xP[(1/T)(1+Y)Y]^{\frac{1}{2}}$ | C-discharge coefficient |
| 03 $P_u' = P_uK(\dot{W}_a)^2$ | $A_x$ function of power level |
| iteratively until $n_{th}$ value of $\dot{W}_a$ | K-experimetal constant |
| comes within 0.1% of the $(n+1)_{th}$ value. | p-set power level |
| 04 $W_a = K_a'a'K_aK'p\dot{W}_a$ | $K_a'a'$, $K_a$ and K'-experi- |
| II Fuel-Amount/Cycle Calculation. | mental coefficients func- |
| 05 $W_f = (r_o + kp)W_a$ (NOTE: see Ac- | tion of p, and $r_o$ and k |
| celeration and Deceleration Control:) | are design constants. |
| III Fuel Injection Charateristics Cal- | $C_i$-design constant in- |
| culation. Solve: | cluding $\rho^+$ and $h_c^+$. |
| 06 $(P_i - P_u)^{\frac{1}{2}}.\Delta t_f = W_f/C_i$ and | K*-experimental coef- |

-continued

| GENERAL FLOW CHART (POPPET VALVE SYSTEM EMBODIMENT) | |
|---|---|
| Step # Equations & Solving Sequence | Coefficients and Results |
| $P_i = K^*.\Delta t_f + P_u$ iteratively until the $(n + 1)_{th}$ values of $P_i$ and $\Delta t_f$ are within 1% of the $n_{th}$ values obtained previously. | ficient and a constant. $P_u$ may be $P_u$ above or be given a fixed value. $P_i$-fuel injection pressure required. |
| THIS CONCLUDES THE FUEL INJECTION PARAMETER COMPUTATION FOR THAT CYCLE. | $\Delta t_f$-fuel injection duration in cycle. |

$^+\rho \rightarrow$Fuel density
$h_c \rightarrow$Specific combustion heat

In the case of the automatic valving system embodiment, equation 04 is (04') $W_a = K_{a'} \cdot K_{a''} \cdot \dot{X} \cdot \dot{W}_a$ in which $\dot{X} = l/\delta t$ (04'') where: $K_{a'}$ and $K_{a''}$ are coefficients varying with p and established experimentally for various values of p; l is a fixed length and $\delta t$ is the time taken by the piston to travel length l. All other equations remain the same and are applicable, only equation 04' needs be substituted for equation 04 and equation 04'' needs be added and inserted between equation 03 and equation 05, in the general flow chart above.

In the case where the macrotemporal method is used, equation 04 is (04*) $W_a = K_n \cdot (\Delta t/n_c) \cdot \dot{W}_a$, where $n_c$ is an odd number of counted cycles and lasting $\Delta t$ which is measured by a real time clock. Only equation 04* needs be substituted for equation 04 in the general flow chart above. It is assumed here that the pressure of the compressed air inside the combustion chamber is measured in the manner used for the microtemporal method. In such case it is easier to use both methods concurrently and appropriately as was discussed earlier for the purpose of recalibrating the microtemporal, from time to time as needed.

The manner in which the various delays and/or event durations defined previously are determined needs some elaboration. They are classified in groups according to their natures: some are expressed in real time, some in fraction of $\tau_c$ and some are dependent upon another time delay being initiated.

GROUP I (real time): $\Delta t_f$(computed above), $\delta t$ and $\delta t_i$.

GROUP II (fixed initiation time): $\delta t_v$, $\delta t_b$, $\delta t$, $\delta t_{b'}$, $\delta t_f$, $\Delta t_v$, $\Delta t_o$, $\Delta t^*_v$, $\Delta t_m$, $\Delta t_M$, $\Delta t_e$, $\Delta t^*_o$ and $\Delta t'^*_o$.

GROUP III (adjustable initiation time): $\delta t_i$.

$\delta t_i$ is both in GROUPS I and III, $\delta t$ is both in GROUPS I and II. This is because $\delta t_i$ (ignition delay) depends on the fuel nature and may have to be positive or even negative (advance ignition for air warm up for some fuels and depending upon the combustion mode desired: i.e. quasi-explosive or Diesel) and such behavior depends on real time (not on the piston motion), and because ignition must be related temporarily to the presence of fuel in the vicinity of the spark plug. $\delta t$ is calculated in real time, for computing $\dot{X}$, and the timing of its initiation is fixed (point 2 of FIGS. 20 and 21).

The determination of some delays and event durations, as required, is performed by the CPU computer. This determination is as follows, whenever not already mentioned previously:

$\delta t_i$—function of an adjustable coefficient $K_i$ (signal inputed by the operator and depending upon the fuel used) and $\delta t^*$ (fixed reference time delay based on the combustion member design and experimental data);

$\delta t_v$—function of an adjustable coefficient $K_v$ varying with the value of $\dot{X}$ calculated in the preceding cycle;

$\delta t_f$—function of an adjustable coefficient $K_f$ varying with the fuel nature and $\dot{X}$ as computed in the preceding cycle;

$\Delta t^*_v$—function of p as earlier mentioned;

$\Delta t_m$ and $\Delta t_M$—both function of p as earlier mentioned; and $\Delta t^*_o$ and $\Delta t'^*_o$—both function of $\dot{X}_{(2-6)}$ and of a variable coefficient $K_o$ (and $K'_o$) adjustable by the operator as a result of observed engine operation.

The values of operator-adjustable coefficients $K_i$, $K_f$, $K_o$ and $K'_o$ are selected by the operator, fed into the CPU memory by means of representative signals inputed by the operator, depending on the fuel he/she desires to use and observations made of the resulting engine operation. Values of $K_v$ and the $\dot{X}$-correction of $K_f$ are computed by the CPU computer internally as a function of $\dot{X}$ or $\dot{X}_{(2-6)}$, as the case may demand, and utilized to adjust their respective delays.

The complexity of the detailed discussion above of the engine operation control requires considerable simplification in graphical representation, for easy understanding. The illustrations of FIGS. 24–25 (schematic functional diagrams) and of FIGS. 26–27 (block-diagrams/flow-charts combinations) present such simplified versions of the two control systems, for the automatic valve and the poppet valve embodiments. The distinction between microtemporal and macrotemporal methods is ignored. Accessories well known in the art such as fuel system (pump and pressure regulator) and high voltage generator are not shown. It is understood that they are located between the signals coming from the output ports and the fuel injectors and the spark plugs, and their respective accessories. Also the details of the generating and handling of timing signals and/or signal durations are omitted for the same reasons. The complex computerized handling of the various air pressures are symbolically replaced by P, $\Delta P$ and $\delta P$ representing then an air pressure level and pressure drops, which suffices for representing the manner in which the air flow rate is measured. The step from rate to metered amount is sidestepped.

FIGS. 24 and 26 correspond to the automatic valving system in which power shaft 29 of engine 1 delivers a torque $\tau$ at N rpm and supplies power $\rho$ demanded in the form of signal p. Compressor 3 delivers compressed air to storage-tank/heat-exchanger 30 which receives combusted gas from combustion member 100 in which the displacement of free piston 130 is detected by sensor 238. Air intake valve 270 monitored by actuator 273 controlled by a signal from the CPU adjusts the air amount admitted in the combustion chambers. Fuel injectors 110 and spark plugs 142 controlled by means of the CPU insure the fuel combustion. The resulting combusted gas is ducted through by-pass valve 280 monitored by actuator 281 controlled by a signal from the CPU and check valve 290 into the storage-tank-/heat-exchanger. The compressed air is heated and both its temperature and pressure are detected by sensors 268 and 264 respectively. Dump valve 310 monitored by actuator 311 may vent both compressed air and combusted gas out to ambient when actuated by a signal from the CPU. By-pass valve 280 and dump valve 310 operate only when the engine operation ceases. The components entitled VALVING, FUEL and IGNITION schematically represent valves 270, 280, 300 and 310 monitoring system, the fuel pump and its pressure regulator, and the high voltage supply system of the spark plugs, respectively. Signal line 259 shown in phantom line represents symbolically the connections inside the CPU which input the signals computed in the CPU and are output signals as is indicated in the previous general flow chart.

The corresponding block diagram of FIG. 26 depicts how the input signals representative of compressed air pressure P, temperature T and pressure drop $\Delta P$ through the air intake valve are combined with the air intake valve area A to obtain the amount of compressed air introduced in each combustion chamber. The detected location X of the piston combined with timed $\delta t$ yields $\dot{X}$ or the average piston velocity earlier mentioned. Fuel amount $W_f$ is computed from $W_a$, and from which the fuel injection pressure $P_i$ and the fuel injection time $\Delta t_{inj.}$ ($\Delta t_f$) are calculated. The past and future (anticipated) locations X of the piston, and its average velocity $\dot{X}$ are used to determine the times ($t_{inj.0}$ and $t_{ign.0}$) at which the fuel injection and the spark plug ignition are to be activated. The engine output is indicated as being the power delivered, the combustion temperature, its corollaries the exhaust gas temperatures, the combustion efficiency and the pollutant content of the exhaust gases.

FIGS. 25 and 27 correspond to the poppet valve embodiment which has many traits in common with the arrangements of FIGS. 24 and 26 just discussed. Their discussion is not repeated here, only the new and different traits need be. The compressed air pressure drop $\delta P$ through the inlet valves is measured by pressure differential transducers 251 mounted on the combustion chamber walls and also connected to the compressed air inlet manifold so that the $\delta P$ signal may be transmitted by means of line h—h to an input port. Each poppet valve system (inlet and outlet) has its own monitoring pilot valve system indicated as INLET V. and OUTLET V. These monitoring pilot valves are supplied with high pressure hydraulic fluid by a pump system not shown. These monitoring pilot valves also control combusted gas shut-off valve 300 and dump valve 310. As shown previously but not mentioned, an ON/OFF switch is used to turn on or off the engine operation. Because the amount of compressed air admitted per cycle is indirectly adjusted by the operator, the signal p indicative of the power $\rho$ demanded is shown inputed into a component LINK which affects the limits of the amounts of air $[W_a]$ and fuel $[W_f]$ by means of combining the m and M timing limits shown in FIG. 21 which set the minimum and maximum opening durations of the inlet valves which determines the experimental values of $K'_a$ of equation 04.

In FIG. 27, a simplified block diagram illustrates the way $\delta P$, P, T and $[W_a][W_f]$ combine to determine $W_a$. That value of $W_a$ combined with $[W_f]/[W_a]$ then determines $W_f$ which in turn determines the fuel injection characteristics earlier discussed. The rest of the block diagram is identical to that of FIG. 26. In such simplified representation, the operator-adjustable coefficients $K_i$, $K_f$, $K_o$ and $K'_o$ which are inputed by means of an input port, have their corresponding signals omitted in FIGS. 24 to 27. Also, for the sake of simplification the broken signal lines such as a—a, b—b, etc. . . . only indicate that a signal is being transmitted through that line, but not the nature of the medium used to transmit it, which may change along the line, i.e. electric to hydraulic or vice versa. The nature of the transmitting medium does not affect the operation principle and is immaterial in the understanding of such operation, as is well known in the art. It should be understood that by-pass valve 280, shut-off valve 300, dump valve 310 are not in use during normal engine operating conditions and are not needed then. Due reference is made to their role and necessity later in this section.

The sequence of the operation steps taken to start and stop the engine are shown in FIGS. 28 and 29 respectively. Reference may also be made to FIGS. 24 and 25 just discussed, but in which sub-systems such as the starter and the piston brake are not shown, although described and discussed earlier. In the later discussion of the stopping cycle, it is shown that the free piston is held in place and secured by a locking device activated after the brake system has stopped the piston. Such device, being considered part of the brake system, is not specifically mentioned in FIGS. 28 and 29, but referred to in the general appellation of brake. The engine starting cycle begins when the operator turns the ON/OFF switch on. At that time, the CPU is activated, the by-pass and the dump valves close. The engine starter starts the engine rotating and accelerating while air is being compressed and discharged in the storage tank where air pressure P builds up. The exhaust shut-off valve, still being kept closed for a while, starts opening slowly. When both N and P have reached specified levels, several operating steps occur: (1) the inlet or intake valve opens, (2) the piston brake is released when the air pressure in the combustion chamber with the open inlet (intake) valve reaches a specified level and the piston is freed, (3) the CPU determines $W_f$, its timing and the ignition timing from data stored in its memory and pertaining to the starting cycle, (4) the outlet valve (or a shut-off valve between the combustion member and the by-pass valve in the case of the automatic valving system) of the combustion chamber opposite to that in which the first combustion is initiated is maintained closed so that pressure may build up when the piston compresses the air therein for providing the rebouncing action needed for insuring the proper operation of the next cycle, (5) a few cycles are then completed in order to build up the pressure of the combusted gas stored in the heat-exchanger/storage-tank, (6) the exhaust shut-off valve 300 (referred to as EXHAUST in FIGS. 28 and 29) keeps opening slowly at a variable rate monitored by the CPU and function of the signals generated during the early operation cycles being completed, and (7) idle operating conditions are finally reached, at which time the starter assistance is no longer needed and it is turned off. It should be mentioned that, during the few starting cycles of the piston, the CPU sets up the normal conditions under which the combustion member is to function at and beyond the idle operating speed.

Referring now to FIG. 29, where the engine stopping sequencing steps are illustrated time-wise, the sequence begins when the ON/OFF switch is turned off and when the stop cycle starts. The CPU is kept ON until all operations have ceased, for monitoring purposes. The fuel injection and the ignition are first turned off. The by-pass valve then closes slowly at a variable rate monitored by the CPU so as to insure that the piston always rebounces to a position where the brake is effective. The dump valve opens so as to empty the storage tank. The inlet (intake) valve starts closing at a variable rate adjustable by means of the CPU and coordinated with the rate of opening of the by-pass valve. The exhaust valve 300 closes to stop admission of combusted gas in the engine expansion chamber, abruptly. When the piston travel, velocity and location conditions are deemed right by the CPU, the brake is applied. The piston is stopped within its locking range and the locking-securing device is engaged. Upon securing of the piston, the hydraulic pressure applied to the brake is relieved and the CPU is then turned off at the end of that pressure relief. The engine is then, and only then, considered stopped and having become entirely inoperative.

The starting and stopping cycles described above bear similarities with those of gas turbines. However, the major differences stem from the following facts: (1) the compression ratio of the engine does not depend on its rotational speed, and the building up of P levels depends only upon the volume of the storage tank compared to the air flow rate delivery of the compressor, (2) hence, much less time and energy is required to bring the engine regime to the point where the combustion member begins to contribute to power delivery, (3) because of the decoupling between the engine and the combustion member, and the presence of the storage tank, the engine rotational speed and the critical amount of compressed air required to complete the first triggering cycle of the piston are unrelated, and (4) the possibility of holding the piston until air pressure conditions are satisfactory insures the certainty of combustion of the first quantity of fuel injected, provided that the ignition operates satisfactorily. From the above discussion, it also becomes apparent that such engine cannot stall like piston engines (specially gasoline engines) or flame out like gas turbines do. The engine may stop rotating while the combustion member may keep operating for another few cycles in a satisfactory manner.

Because special and specific actions must be taken during the starting and the stopping phases of the engine operation, provisions are made in the central processing unit for processing and generating signals during these two phases that are internally programmed and sequenced in a manner such that these actions happen automatically. During the starting phase, between the time when the piston has started its second cycle and the time when the engine has reached idle speed, the part of the central processing unit which controls the normal operation of the engine cooperates with the special processing means which are in charge of scheduling such actions. When a set of engine operating conditions, such as N and P having reached specified levels, are obtained, a signal is generated and applied to the central processing unit for shutting off the operation of the special processing means. During the stopping phase, the special processing means receives and processes signals representing the piston average velocity. When the piston average velocity immediately following a rebounce at the end of a stroke becomes less than a specified value, a signal from the central processing unit is generated and applied to the brake system for arresting the piston. The locking in place of the piston then generates a signal from the locking-securing device so as to cause the central processing unit to shut itself off entirely, including the special processing means. Such self activating and/or inactivating, and control switching functions of control systems are well known in the art and need no further elaboration.

Acceleration and Deceleration Control:

For short periods of time, during brusque prolonged accelerations, peak combustion temperatures higher than maximum values tolerable for maximum power steady-state conditions are acceptable, for these transient conditions occur only during a very minor fraction of the life of the engine. The amount of polluting $NO_x$ thus produced is negligible. However, the capability of an engine to provide high rates of power increase is very important for automobile users for instance. At this juncture, the significance and importance of equation 05 and of the graph of FIG. 38 needs additional discussion.

The straight line of the FIG. 38 graph represents equation 05 in which $W_f/W_a$ is function of power level p. If the amount of fuel were always determined by equation 05, during a minor acceleration from point a to point o for instance, the ratio $W_f/W_a$ could not exceed the level indicated by line v which corresponds to a value $p_o$ of the power level. As a corollary, a deceleration from o to a could not cause the fuel/air ratio to become lower than the level of line u. Especially at low power level settings, it is obvious that such a limitation might severely limit both the acceleration and deceleration rates. Such limitations are almost certainly unacceptable for propulsion applications of the external combustion engine. The maximum steady-state fuel/air ratio (point $p_\pi$, line M) is lower than the maximum level (MAX.) corresponding to the stoichiometric and acceptable for short bursts. Also, because the flame-out case of gas turbines and the "missing" case of gasoline engines have no equivalent in the case of the engine of the present invention and are not feared, it is advantageous to lower the fuel air ratio to its minimum practical value (MIN.) which is higher than line m corresponding to point i and $p_i$. A practical consideration arises at power levels close to idling during brusque decelerations: i.e. that of the adequate injection of very small amounts of fuel for which either the injection time must be very short or the injection pressure becomes to low to obtain a satisfactory fuel physical break up. To accommodate this contingency, another lower limit represented by line y joining point i to point x, corresponding to $p_{(x)}$, may then be used to override the limit set by line m. Adding the following equations to those of the GENERAL FLOW CHART with the program instructions indicated below then enables the fuel/air ratios to vary during transient conditions as shown by paths a-b-c-d (acceleration) and e-f-g-h (deceleration). Equation 05 is not used then and equation 05' below is used instead:

$$W_f = R_{(p'-p'')} \cdot W_a \qquad (05')$$

where $R_{(p'-p'')}$ replaces $(r_o+kp)$ and which assumes the following values:

R* when the absolute value of $(p'-p'')/p_\pi$ is larger than $\mu$, and p' is less than p'' (acceleration case);

$(r_o+kp)$ when the absolute value of $(p'-p'')/p_\pi$ is less than $\mu$;

$r^*$ when the absolute value of $(p'-p'')/p_\pi$ is larger than $\mu$, and $p'$ is larger than $p''$ (deceleration case) and $p''>p_{(x)}$; and $(r'_o-k'p)$ when $p''<p_{(x)}$ (deceleration at low power levels).

Whenever the absolute value of $(p'-p'')/p_\pi$ is lower than $\mu$, the engine acceleration (or deceleration) is mostly the result of the increase (or decrease) in the amount of air introduced in the combustion chambers as a direct consequence of the inlet valving capability variation which always occurs simultaneously with a change in power level demand. The definitions and meanings of the newly intoduced fixed and adjustable constants above are as indicated hereinunder:

$p'$—power level setting at the start of the p change (set), $p''$—power level setting demand (set), may be higher (acceleration case) or lower (deceleration case) than $p'$, $p_i$—power level setting at idle (may be adjustable), p—power level setting for maximum power level (adjustable), $\mu$—ratio of power level setting change to maximum power level setting (computed by the CPU for each change) (adjustable), $R^*$—constant corresponding to the value MAX. of $W_f/W_a$ of FIG. 38 and representative of the maximum combusted gas temperature acceptable during short bursts of power increase, $r^*$—constant corresponding to the value MIN. of $W_f/W_a$ of FIG. 38 and representing the lowest and leanest $W_f/W_a$ ratio, $p_{(x)}$—value of p for defining the slope of line y limit in FIG. 38 and corresponding to limitations set by the fuel injection for obtaining a satisfactory combustion (adjustable), $r'_o$—constant corresponding to but higher than $r_o$ (adjustable), $k'$—constant corresponding to (but negative) k, determined by the values of $p_{(x)}$, $p_i$, MIN. and line m (adjustably fixed).

$\mu$ is adjustable by the operator and determines the frequency of the use of equation 05', said frequency being function of the type of driving (city compared to highway) and driver's habits. It should also be adjusted to best fit the combustion requirements set by the fuel type and nature. Other adjustable constants are set by the engine operator according to the fuel type and nature. The adjustments of $p_i$ and $p_\pi$ are mostly a matter of operator's choice and driving habits.

As a last refinement, $\mu$ may be made a function of $p'$ and $p''$ in a number of ways and which are beyond the scope of this disclosure. Suffices it to say that the flexibility of conforming the combustion requirements to the fuel burned and pollution limitations is adequately provided by such a control approach, during engine accelerations.

The series of equations and conditional instructions listed above is handled by the CPU by inserting a test condition based on comparing $(p'-p'')/p_\pi$ to the value of $\mu$ stored in the memory to: (1) proceed forward with equation 05, or (2) follow the loop of equation 05' with its attendant side calculations, before proceeding to equation 06 of the GENERAL FLOW CHART, and so on; depending upon the step testing results.

In conclusion, this new type of engine as described and disssed above offers possibilities of greatly improving the art of combustion engines. Such possibilities appear even more promising with the advent of technologies pertaining to exotic materials which may operate at high temperatures without the usual requirements of cooling and lubrication. Two categories of such exotic materials are: (1) carbon and/or graphite and/or composites thereof, and (2) ceramics. In the present application, the possibility of combining the use of materials of both categories in the same engine assembly is extremely appealing.

Firstly, the use of graphite/carbon or graphite/graphite 3-D reinforced materials for both the static and moving parts of the compressor and gas expansion components lowers the need of cooling and/or lubrication requirement and simplifies thermal expansion accommodation. Because of the small coefficient of thermal expansion, high heat capacity and good thermal conductivity of such materials, sealing problems could be minimized. The strength of these materials increases with temperature up to a point that happens to be close to that where their strength characteristics peak. The use of graphite/carbon matrices and graphite/carbon reinforced fibers for the engine rotor, the vanes vand the housing could easily facilitate sweat cooling and/or lubrication of such parts. Utilization of such materials, could enable the combustion member to operate at temperatures higher than those acceptable for steel alloy components. Because of the absence of mechanical connections between the combustion member and the engine proper, except for air and gas ducts, and mounting supports, the materials used for each member can then be of quite different nature, i.e.: Carbon/Graphite for the combustion member and conventional metals for the heat exchanger and some parts of the power delivery means, should such combination of materials prove to be the most judcious. A lifetime expectancy of the external combustion engine much longer than that of conventional piston engines may then result and seems possible in the near future.

Much less is known about ceramics for which the state-of-the-art is still far from adulthood. However, great strides are constantly being made and their applicability technology is rapidly developing. At the present time, their natural brittleness is a drawback for their application to internal combustion engines, in which vibrations and shock levels are high. However, the shocks and vibrations inherent to the external combustion engine of the present invention are of a nature and of a level such that ceramics brittleness may prove not to be of much hindrance. The possibility of complete elimination of cooling and/or lubrication with such materials is of tremendous interest, for it must be remembered that no or little side forces are exerted onto sliding parts. Clearance, sealing and/or wear problems so critical for internal combustion engines have thus their importance minimized.

Another inherent characteristics of the vane engine is given its full possibility in the engine construction of the present invention, that of having a gas expansion ratio larger than the compression ratio, as is the case for all gas turbines. The end results are exhaust gases leaving at much lower velocities and a higher thermodynamic efficiency (smaller energy losses). This is possible only because the air compression chamber and the combusted gas expansion chamber do not share functions as they do in piston engines. They can then differ volumetrically in a manner much akin to that of gas turbines. The combination and compounding effects of these contributions constitute a significant potential improvement in the overall efficiency of the external combustion engine of the present invention. The facilitated incorporation of a heat exchanger further heightens this overall efficiency improvement.

The possibility of burning fuel more slowly and completly, especially during abrupt and large power increases, reduces the fuel consumption, the peak combustion temperatures and also the amount of pollutants created, and further increases the combustion efficiency. Non-fossil fuels, inexpensive and strategically less critical, less volatile and easier to store and handle, could then be used extensively, thereby reducing the incident pollution caused by the refining, storage and transportation of more volatile fuels such as gasoline. The savings in the cost pollution control (vehicles and fuel handling) themselves are staggering. The cold weather starting of the external combustion engine should also prove much easier than that of piston engines, more like that of gas turbines.

The volume and weight per unit of power should be smaller because the bulky crankcases are eliminated. The heavy and cumbersome connecting rods and crankshaft assemblies are no longer needed. The geometrical adaptability to confined spaces of the external combustion engine is excellent because the physical relationship of its main members is not fixed, but very flexible. Easier and less costly maintenance should be the results.

It should also be noted that the number of moving parts is minimized. The parts of very different natures and/or functions are not mechanically connected. The free piston is totally independent from the power delivery shaft. The high velocity parts do not change direction (vanes) and their positions relative to their guiding member never vary abruptly. In the poppet valve embodiment, the only bothersome parts are these valves which are also bothersome in internal combustion engines. The automatic valving embodiment construction eliminates such drawback, thus opening the door to the generalized use of ceramics in the construction of this type of engine. The ultimate potential being the possibility of an engine requiring no cooling and no lubrication, with low fuel consumption, low pollution levels and being capable of burning less expensive and more abundant less refined fuels, not necessarily of fossil extraction.

Because half of the energy converter (latent chemically stored heat into elastically stored energy) is embodied in one member mechanically uncoupled to the other half of the energy converter (elastically stored energy into usable mechanical energy), which prevents direct mechanical access to the moving part of the first member, the control of the starting, stopping and normal running engine operations is necessarily complex. This is even more so if one wants to take advantage of all the potential possibilities offered by the external combustion engine inherent to its ability to burn fuels very slowly, over periods of time ten times larger than the time period available with modern internal combustion engines. However, most of the complexity is resolved by the resides in an electronically constructed control system which is of an extreme simplicity, as far as electronics is concerned, past state-of-the-art one might say.

It is thought that the external combustion engine of the present invention and many of its attendant advantages will be understood from the foregoing description and it will be apparent that various changes may be made in the form, construction and arrangement of the parts thereof without departing from the spirit and scope of the invention or sacrificing any and all of its material advantages, the form hereinbefore described being merely a preferred examplary embodiment thereof.

Having thus described my invention, I claim:

1. A method for controlling the operation of an external combustion engine wherein said engine comprises a compressor for compressing ambient air for supply to a combustion member including a free piston travelling between two end closures of a sleeve in which said piston slides reciprocatingly thus defining two combustion chambers between each end closure and the corresponding end of the piston and in which fuel is introduced for burning and the combusted gas resulting therefrom is expanded in an expansion member of the engine for driving the compressor and a power delivery member, attachments to both the piston and the sleeve end closure which cooperate for imparting a rotational movement to the piston during its reciprocating sliding axial motion thus providing two coordinated motions of the piston for location and motion direction detections so as to generate signals, air inlet and gas outlet valving means in the combustion member, a compressed air and combusted gas storage tank located between the power delivery member and the combustion member, means for sensing the pressure and temperature of the compressed air in said tank, means for introducing the fuel and means for igniting the fuel, a brake system located between the piston and the sleeve cooperating attachments, means for detecting the piston axial location in the sleeve, means for sensing compressed air pressure downstream of the storage tank and of a metering orifice, means for setting the power level that an engine operator demands, and a control system including a central processing unit having input ports, output ports and memory storage, said method comprising the steps of:

generating a first set of signals from the compressed air pressure and temperature sensing means, said first set of signals representing the conditions of the air to be later introduced inside the combustion chambers;

generating a first signal from the piston location detecting means when the piston reaches the end of each and every stroke, said first signal representing both the time at which the beginning of a piston cycle and the end of the previous cycle occur;

generating a second set of signals from the piston location detecting means during the first quarter of the piston stroke, said second set of signals representing the beginning, the end and the duration of the period of time taken by the piston to travel a fixed distance along its axial movement;

generating a second signal from the piston location detecting means during the fourth quarter of the piston stroke, said second signal representing the time at which the piston reaches a known and fixed location toward the end of its stroke;

generating a third signal from the the pressure sensing means located downstream of the storage tank and of a metering orifice representing the compressed air pressure in the combustion chamber being filled with air, during a short instant following the initiation of the generation of the second set of signals;

generating a fourth signal from the means for setting the power level demanded by the operator, said fourth signal representing a set fraction of the range of power levels that the engine is capable of delivering between idle and full power settings;

processing each one of said signals of the second set to generate a fifth signal representing the average velocity reached by the piston during the fixed distance travelled, and located in the first quarter of its stroke;

processing each of said signals of the first set in combination with each of said second, third, fourth and fifth signals to generate a sixth signal representing the total amount of air to be introduced in the chamber being filled with compressed air during the open period of the inlet valving means;

processing each said sixth signal representing said amount of air in combination with each said fourth signal to generate a seventh signal representing the amount of fuel to be introduced for combustion in the combustion chamber during the remnant of the piston stroke; and processing each said seventh signal representing the amount of fuel to be burned to generate an eighth signal representing the ignition time for initiating the activation of the means for igniting the fuel;

whereby the fuel burns in the compressed air to provide the energy required of the gas expansion member so as to produce the power demanded of the engine by the operator.

2. The method recited in claim 1 wherein minimum and maximum values for the fuel-amount to air-amount ratio are established for each type of fuel to be used and are stored in the central processing unit memory and wherein a set value of said ratio is established for each power level setting of the engine, said method comprising the further steps of:

generating a ninth signal from the fuel/air ratio values stored in the memory representing the ratio limits which the value of the seventh signal is not allowed to exceed in either direction; and processing each of said seventh and ninth signals to insure that, during large rapid variations of the power level demand, values of the seventh signal are enabled to reach the limit values of the fuel/air ratio represented by the ninth signal;

whereby: (1) a maximum average temperature of the combusted gas in the combustion chamber is never exceeded while maximum acceleration rates of the engine are always available, and (2) the engine deceleration rate is automatically maximized.

3. The method recited in claim 2 wherein the fuel is provided by a fuel system at a pressure which enables fuel injectors to finely break the fuel jet into the combustion chamber for efficient and fast burning and during a period of time such that the amount of fuel injected corresponds to the amount required for each piston cycle, and wherein the burning characteristics of various types of fuels are stored in the central processing unit, said method comprising the further steps of:

generating a tenth signal from the central processing unit memory storage and representing the burning characteristics of the fuel being used in the engine as indicated by an engine operator;

processing said seventh and tenth signals to generate a third set of two signals, one representing the fuel injection pressure and the other representing the duration of the fuel injection;

applying the fuel injection pressure signal to means for adjusting said pressure for each piston cycle, and the fuel injection duration signal to timing means for causing the fuel injection to start and to stop at determined times during the piston stroke in response to said central processing unit generated signals;

whereby both the values of the fuel injection pressure and of the fuel injection duration are optimally balanced between set limits so as to cause the fuel of the type being used to burn most effectively and efficiently during said piston stroke.

4. The method recited in claim 1 wherein means for adjusting the values of variable coefficients used by the central processing unit are provided, said method comprising the further steps of:

processing each combination of each of said first signal and second signal, said combination representing the time elapsed from the start of the piston cycle to the time at which the piston reaches a known and fixed location during the fourth quarter of the piston stroke to generate an eleventh signal representing the piston average velocity over said elapsed time;

comparing each value of said eleventh signal with each corresponding value of the fifth signal to generate a twelfth signal representing the amount of adjustment by which the variable coefficient used by the means for generating the fifth signal must be corrected to make the values of the fifth and eleventh signal coincide within a specified percentage differential value, and applying said coefficient adjustment to the means for generating the fifth signal during the next piston cycle;

whereby, during quasi steady-state engine operation, the piston average velocity determined during the first quarter of the piston stroke is caused to approximate very closely the piston velocity averaged over most of its stroke, thereby providing more accurate timing means during the second and third quarters of the piston stroke.

5. The method recited in claim 3 wherein the operational timing of the inlet and the outlet valving means is directly and automatically regulated by the two piston coordinated motions, said method comprising the further steps of:

generating a thirteenth signal from the piston location detecting means when the piston reaches the end of the $n_{th}$ cycle, n being a specified whole odd number of cycles counted from the start of the first cycle of said n cycles;

measuring the time elapsed between the first signal of said first cycle and said thirteenth signal at the end of the $n_{th}$ cycle to generate a fourteenth signal representing a piston cycle average duration and to generate a fifteenth signal representing the piston average velocity over said elapsed time; and processing each of said fourteenth and fifteenth signals to generate a real time reference base for relating piston location timing to real-time timing;

whereby fuel injection duration may be expressed in real time and ignition means timing may be expressed in fraction of piston stroke and cycle duration.

6. The method recited in claim 4 wherein the inlet and outlet valving means includes poppet valves situated on the sleeve end closures and the operation of said valves is actuated by control means, said method comprising the further steps of:

processing each said first signal representing the origin of each piston cycle and each said eleventh signal obtained during the preceding cycle to generate a sixteenth signal representing the time at which the corresponding inlet valve is to open;

applying said sixteenth signal to the inlet valve actuating control means during the first quarter of each piston cycle;

processing each said fourth signal from the means for setting the power level demanded by the operator to generate a seventeenth signal representing the time at which the corresponding inlet valve is to close for adjusting the amount of compressed air introduced in the corresponding combustion chamber;

applying each of said seventeenth signal to the corresponding inlet valve actuating control means;

processing each said eleventh signal representing the piston average velocity over most of its stroke to generate a fourth set of two signals representing the times at which the outlet valves will open and close before the end of said piston stroke, the first one of said fourth set signals corresponding to the opening of the outlet valve of the combustion chamber in which fuel combustion occurs during said piston stroke and the second one of said fourth set signals corresponding to the closing of the outlet valve of the other combustion chamber located at the opposite end of the sleeve, said outlet valve opening being timed to occur prior to said outlet valve closing; and applying each one of said signals of said fourth set to the outlet valve actuating control means;

whereby: (1) the inlet valves are caused to timely open and close for controlling the amount of air admitted in each combustion chamber during each and every piston cycle, thereby adjusting the engine power delivery capability, (2) the opening created by an open inlet valve constitutes the air metering orifice, (3) the needed amount of combusted gas is caused to remain trapped between the piston end and the corresponding sleeve end closure to insure the timely bouncing back of the piston at the end of its stroke, and (4) at least one outlet valve is open so as to provide an uninterrupted flow of combusted gas to the storage tank and the power delivery member.

7. The method recited in claim 5 wherein a compressed air intake valve and associated actuating means are provided between the storage tank and the inlet valving means for adjusting the compressed air flow into the combustion member, said method comprising the further steps of:

processing each said fourth signal from the means for setting the engine power level to generate an eighteenth signal representing the degree of opening of the intake valve corresponding to the power level demanded by the engine operator; and applying each said eithteenth signal to the intake valve actuating means;

whereby the opening offered by the intake valve to the compressed air flow constitutes the air metering orifice needed for adjusting the amount of compressed air introduced in each combustion chamber during each piston stroke.

8. The method recited in claim 3 wherein the engine further includes a dump valve and associated actuating means for venting the storage tank to the atmosphere, an exhaust shut-off valve and associated actuating means for shutting off the compressed gas flow from the storage tank to the expansion member, a starter, means for preventing the combusted gas to flow back from the storage tank to the combustion member and processing means within the central processing unit for automatically scheduling the engine starting and stopping phases, said method further comprising the steps of:

generating a fifth set of signals when the central processing unit is switched on, from the starting processing means, for initiating the engine starting phase, said signals of the fifth set being programmed to be generated and applied according to a set time sequence as follows in the order indicated hereinunder: (1) applying a first signal to the dump valve actuating means so as to close said valve, (2) applying a second signal to activate the starter for compressing air, (3) applying a third signal to the air metering orifice actuating means so as to insure that a combustion chamber fills up with compressed air, (4) applying a fourth signal to the exhaust shut-off valve actuating means so as to slowly open said valve, (5) applying a fifth signal to the fuel introduction means so as to inject a set amount of fuel into said combustion chamber being filled with compressed air, (6) applying a sixth signal to the means for igniting the fuel so as to initiate the first combustion cycle, (7) applying a seventh signal to actuating means for releasing the piston securing means of the piston brake system, (8) applying an eighth signal to actuating means of the outlet valving closing means so as to cause a set amount of ambient air to become trapped in the combustion chamber opposite to that in which said first combustion cycle is taking place, (9) then applying a time-delayed ninth signal to the central processing unit so as to initiate the normal engine operation control and stop the engine starting phase, and (10) applying a tenth signal to the starter switching means to stop its assistance to the power delivery member; and generating a sixth set of signals from the stopping processing means when the central processing unit is switched off for initiating and completing the stopping phase of the engine, said signals of the sixth set being programmed to be generated and applied according to a set time sequence as follows, in the order indicated hereinunder: (1) applying a first signal to the fuel introduction means and to the ignition means so as to stop their operation instantly, (2) applying a second signal to the dump valve actuating means so as to open said valve for venting the storage tank to the atmosphere, (3) applying a third signal to the exhaust shut-off valve actuating means so as to close said valve, (4) applying a fourth signal to the actuating means of the inlet valving means so as to close the air metering orifice, (5) applying a fifth signal to the actuating means of the piston brake system so as to stop and then secure the piston in place, (6) applying a sixth signal to the actuating means of the piston brake system for releasing the brake upon securing the piston, and (7) applying a seventh signal to the central processing unit for shutting itself off entirely;

whereby the processing means for automatically starting and stopping the engine assumes control of the operation of all air and gas flow regulating valves and of the combustion member in response to the central processing unit being switched on for the starting phase and being switched off for the stopping phase and thus insuring that: (1) during the starting phase, the means for supplying compressed air remains power assisted by the starter until the combusted gas expansion member generates enough power to drive the compressor without further assistance, at which time the storage tank has become fully pressurized, (2) no more than a few full piston cycles are required for reaching such self-sustaining operation which defines idle speed, (3) the central processing unit assumes normal control, from the processing means for automatically scheduling the starting phase, of the combustion member operation upon completion of the first piston cycle when the piston has just bounced back from the end of its stroke, (4) during the stopping phase, the piston average velocity continues to be monitored by the central processing unit, (5) the brake system is activated when the average piston velocity after a rebounce becomes less than a set value, (6) the piston is stopped before engaging the piston securing means, (7) the piston brake system becomes inactivated when the piston has been secured in place, and (8) the piston remains secured in place, with the brake system inactive, until said piston is released during a following starting phase.

* * * * *